US008083061B2

(12) United States Patent
Fogel et al.

(10) Patent No.: US 8,083,061 B2
(45) Date of Patent: Dec. 27, 2011

(54) PACKAGES AND PACKAGING SYSTEM

(75) Inventors: James C. Fogel, Marietta, GA (US); Colin P. Ford, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 12/435,048

(22) Filed: May 4, 2009

(65) Prior Publication Data

US 2009/0266872 A1 Oct. 29, 2009

Related U.S. Application Data

(63) Continuation of application No. PCT/US2007/083918, filed on Nov. 7, 2007.

(60) Provisional application No. 60/857,545, filed on Nov. 7, 2006.

(51) Int. Cl.
*B65D 65/00* (2006.01)

(52) U.S. Cl. ..... 206/434; 206/427; 206/429; 206/153

(58) Field of Classification Search ..... 206/430, 206/158, 153, 152, 151, 140, 429, 434, 427
See application file for complete search history.

(56) References Cited

U.S. PATENT DOCUMENTS

| | | | | |
|---|---|---|---|---|
| 2,677,221 | A | 5/1954 | Cleveland et al. | |
| 2,731,776 | A | 1/1956 | Currie | |
| 3,540,582 | A * | 11/1970 | Wood et al. | 206/192 |
| 3,692,228 | A | 9/1972 | Spiegel | |
| 4,394,903 | A * | 7/1983 | Bakx | 206/427 |
| 4,571,923 | A | 2/1986 | Le Bras | |
| 4,801,006 | A * | 1/1989 | Martin et al. | 119/170 |
| 5,044,498 | A * | 9/1991 | Galiegue et al. | 206/429 |
| 5,211,711 | A | 5/1993 | Marco | |
| 5,351,815 | A | 10/1994 | Fogle et al. | |
| 5,351,816 | A | 10/1994 | Sutherland et al. | |
| 5,765,685 | A * | 6/1998 | Roosa | 206/434 |
| 6,270,005 | B1 * | 8/2001 | Enciso | 229/103.2 |
| 6,378,697 | B1 * | 4/2002 | Sutherland et al. | 206/140 |
| 6,926,147 | B2 * | 8/2005 | Holley, Jr. | 206/434 |
| 2006/0191811 | A1 * | 8/2006 | Fogle et al. | 206/434 |

FOREIGN PATENT DOCUMENTS

| | | |
|---|---|---|
| FR | 2 380 959 | 9/1978 |
| FR | 2 547 796 | 12/1984 |
| GB | 2 259 686 | 3/1993 |
| WO | WO 9745338 A1 * | 12/1997 |
| WO | WO 97/45338 | 12/1998 |
| WO | WO 02/062676 | 8/2002 |
| WO | WO 02/079048 | 10/2002 |
| WO | WO 2008/058186 | 5/2008 |

OTHER PUBLICATIONS

PCT/US2007/083918—International Search Report and Written Opinion.

* cited by examiner

*Primary Examiner* — J. Gregory Pickett
*Assistant Examiner* — Raven Collins
(74) *Attorney, Agent, or Firm* — Womble Carlyle Sandridge & Rice, LLP

(57) ABSTRACT

Carton blanks are disclosed for accommodating articles therein to form packages. A packaging system for packaging articles within blanks is capable of packaging a wide variety of packaging configurations.

19 Claims, 35 Drawing Sheets

PACKAGES AND PACKAGING SYSTEM

PRIORITY APPLICATION

This application is a continuation application of prior claims the benefit of PCT Application No. PCT/US2007/083918, filed Nov. 7, 2007, entitled "Packages and Packaging System," which PCT application claims the benefit of U.S. Provisional Application No. 60/857,545, filed Nov. 7, 2006. The entire disclosures of both PCT Application No. PCT/US2007/083918 and U.S. Provisional Application No. 60/857,545 are incorporated herein by reference for all purposes as if set forth in their entireties.

BACKGROUND

This disclosure generally relates to cartons for accommodating containers, packages formed therefrom, packaging systems, and methods of packaging containers.

SUMMARY

According to one embodiment of the present disclosure, a package is formed from a blank comprising a first side panel, at least one top panel, a second side panel, a bottom panel, and at least one receiving aperture in the bottom panel. One or more containers can be accommodated in the receiving aperture. The blank can include, for example, one or more pivot panels that extend downwardly when the containers are loaded into the blank. The pivot panels enhance the rigidity of the package by pressing against the sides of the containers, and also provide "billboard" area upon which product, advertising, and other information can be printed.

According to one aspect of the disclosure, the blank may be provided to a packaging machine in a series of adjacent and/or interconnected blanks. Because the blanks may be interconnected with no spaces therebetween, the packaging operation can be performed faster. Also, the blanks can have a configuration that allows a variety of container arrangements to be accommodated in the blanks, and that provide reduced changeover time to alternate container arrangements. The packages can be assembled on a product pitch machine.

According to another embodiment of the disclosure, a packaging system comprises an article infeed device, a blank feeder, an article transfer device, and a main flight. The main flight may include a plurality of flights moving along a machine direction of the packaging system to convey blanks in the packaging system. The packaging system may be a product pitch machine capable of packaging articles within a series of interconnected blanks. A separation device can be included before an exiting end of the packaging system to separate adjacent blanks in the series of interconnected blanks.

Other aspects, features, and details of the present disclosure can be more completely understood by reference to the following detailed description of exemplary embodiments taken in conjunction with the drawings and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the disclosure.

DETAILED DESCRIPTION

Figure 1:
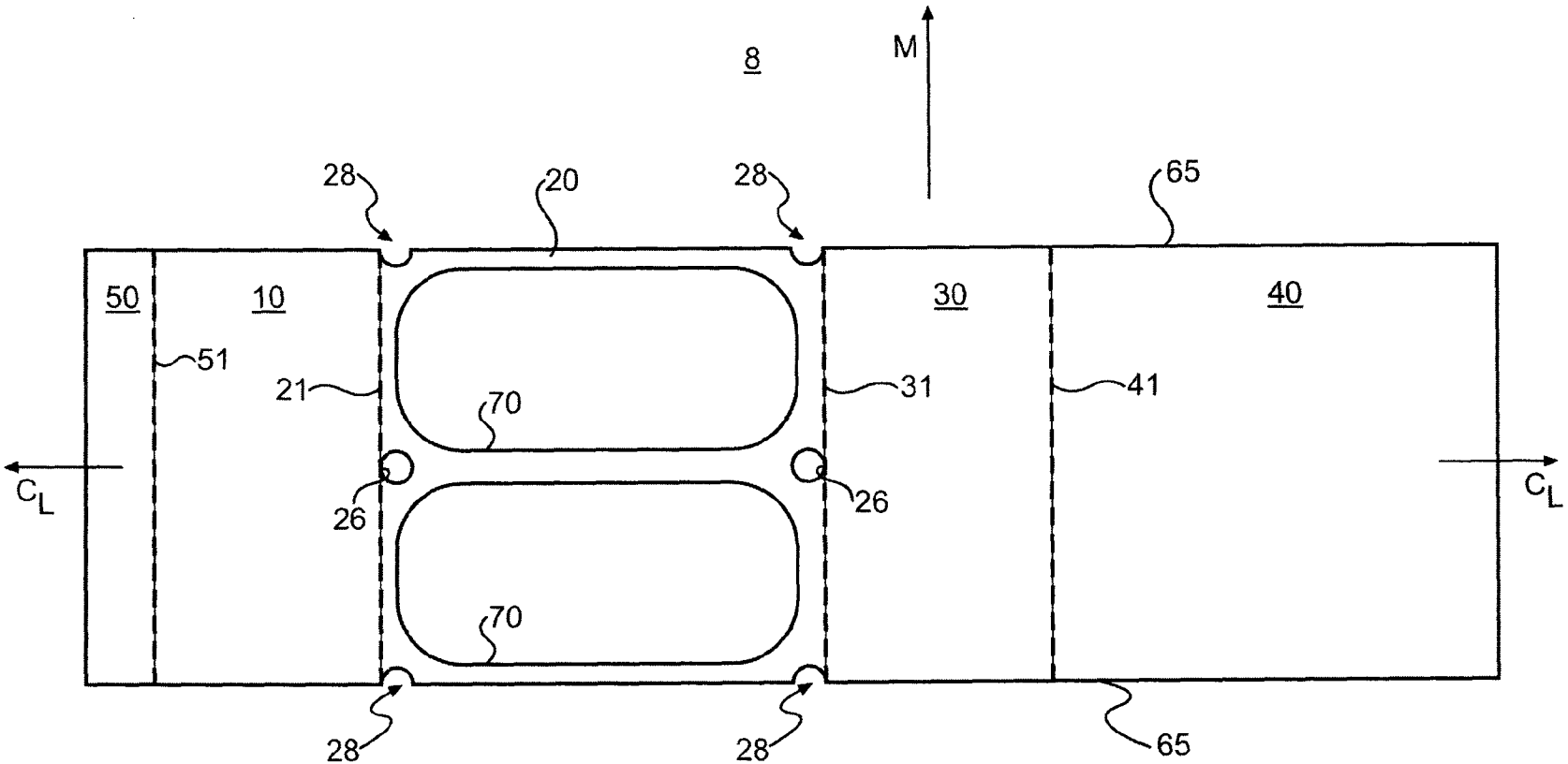
FIG. 1 is a plan view of a blank used to form a package according to a first embodiment of the disclosure.

The present embodiments are generally addressed to cartons for attachment to containers, methods of packaging containers, and packaging machinery. The carrier blanks disclosed in this specification may be wholly or partially symmetric about longitudinal centerlines $C_L$. Therefore, certain elements in the drawing figures may share common reference numerals in order to reflect whole and/or partial longitudinal symmetries. In this specification, the relative terms "bottom," "side" and "top" indicate orientations determined in relation to fully erected and upright packages.

FIG. 1 is a plan view of the exterior or printed side of a blank 8 used to form a carton or carrier 95 according to a first embodiment of the disclosure. The carrier 95 is illustrated in its erected state in FIG. 2, in which it is attached to containers C, forming a package 100. The package 100 accommodates eight containers C in a 2×2×2 arrangement, including two rows (which extend from left to right in FIG. 1) and two columns (which extend vertically in FIG. 1) of containers C, which are arranged in the carton 95 in an upper and a lower tier.

Referring to FIG. 1, the blank 8 comprises a first side panel 10 foldably connected to a bottom panel 20 at a first transverse fold line 21, a second side panel 30 foldably connected to the bottom panel 20 at a second transverse fold line 31, and a top panel 40 foldably connected to the second side panel 30 at a third transverse fold line 41. An adhesive panel 50 may be foldably connected to the first side panel 10 at a fourth transverse fold line 51. One or more cuts may be placed along each of the transverse fold lines 21, 31, 41, 51. In the exemplary embodiment illustrated in FIG. 1, the transverse fold lines 21, 31, 41, 51 are cut/crease lines in which the cuts facilitate folding of the blank 8 at the fold lines. Any number of cuts may be formed along the fold lines, and the number and length of the cuts may be selected according to, for example, the gauge and/or the stiffness of the material used to form the blank 8.

The bottom panel 20 includes a pair of receiving apertures 70. Each receiving aperture 70 is shaped and sized to receive one or more articles, such as containers C (illustrated in FIG. 2) that are to be accommodated within the carton 95. In the exemplary embodiment, each receiving aperture 70 is sized to receive two containers C, which may be connected to one another. The two adjacent receiving apertures 70 therefore accommodate four containers C. One or more locating apertures 26 may be formed in the interior of the blank 8, and one or more locating apertures 28 may be formed along one or more end edges of the blank 8. The locating apertures 26, 28 are used to support, align and/or locate the blank 8 during packaging. When the blank 8 is incorporated as part of a continuous series of blanks 8 that are adjacent to one another and/or breachably joined at their edges 65, each aperture 28 will comprise one half of a full circular aperture.

Figure 2:
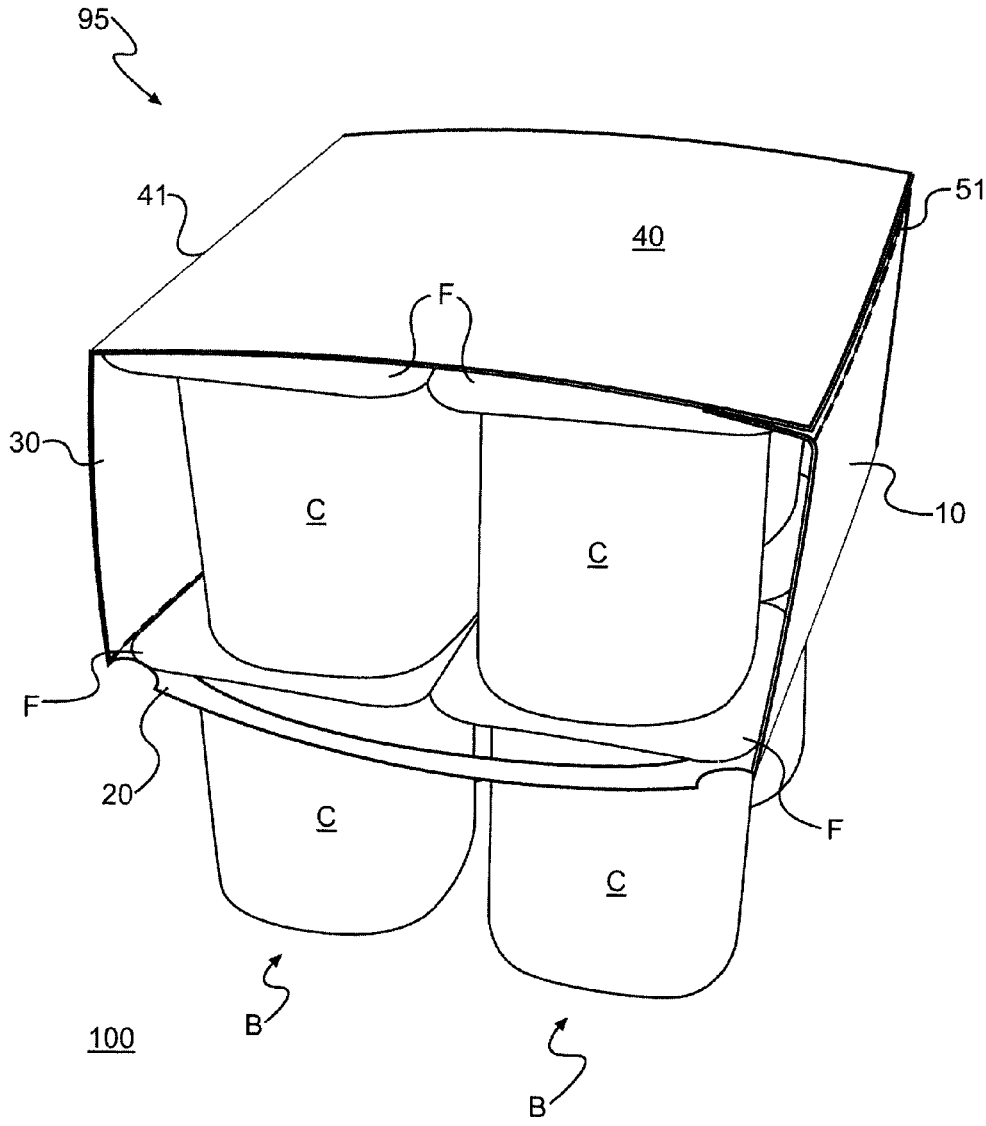
FIG. 2 illustrates the first package embodiment.

FIG. 2 illustrates eight containers C accommodated within the erected carton 95 formed from the blank 8, forming the package 100. The containers C are arranged in a 2×2×2 arrangement of two tiers or layers, with two containers in each row and two containers in each column. Generally described, the package 100 is erected by dropping the base portions B of four containers C, two in each aperture 70, down through the receiving apertures 70 until flange portions F of the containers C engage and are supported on the bottom panel 20. Four containers C may either be subsequently or previously stacked on top of the four containers in the bottom tier of containers C. As an alternative to dropping the base portions B into the receiving apertures 70, the blank 8 may be raised up to engage the base portions B with the apertures 70. The blank 8 is then folded about the transverse fold lines 21, 31 to bring the first and second side panels 10, 30 upward into generally upright positions. The adhesive panel 50 is folded about the transverse fold line 51 over the top of one row of containers C, and the top panel 40 is folded about the transverse fold line 41 to bring the top panel 40 into contact with the adhesive panel 50. The underside of the top panel 40 may then be adhered or otherwise secured to the adhesive panel 50 so that the bottom panel 20, the side panels 10, 30, and the top panel 40 have the generally tubular open-ended form shown in FIG. 2. If desired, the carton blank 8 may be wrapped relatively tightly around the containers C in order to minimize movement of the containers C within the carton 95. The resulting package 100 securely retains the eight containers C.

Referring back to FIG. 1, during packaging operations, the blank 8 may be one of a series of similar or identical blanks that are adjacent to one another and/or breachably attached end-to-end by a breachable line of disruption at the end edges 65. The series of blanks 8 moves through a packaging machine in the "machine direction" or the direction of travel indicated by the arrow M. In the illustrated embodiment, the blank 8 is designed to accommodate eight containers C. According to one aspect of the disclosure, the blank 8 may be divided or separated to form two blanks at the centerline $C_L$, which is a longitudinal line of symmetry for the blank 8, and thereby adapted to accommodate four containers C in a 1×2×2 arrangement. If, for example, 1×2×2 packages are to be constructed, the blank 8 can be provided with a breachable separation line along the centerline $C_L$. The separation line can be a line such as score line, cut line, or other forms of disruption allowing the continuous strip of blanks 8 to be separated from one another during packaging. The blank 8 can also be easily adapted so that it can accommodate more than two rows of containers C. For example, two of the blanks 8 can effectively be joined at end edges 65 to form a blank accommodating four rows of containers C in a 4×2×2 arrangement. Configurations such as 3×2×2, 5×2×2, and other arrangements can be similarly achieved. The ability to vary the number of rows of apertures in the blank 8 allows packages with varying numbers of containers to be constructed with minimal adjustment to packaging machinery. An exemplary packaging machine and methods of erecting blanks and loading containers into blanks are discussed below with reference to FIGS. 19-35.

Figure 3:
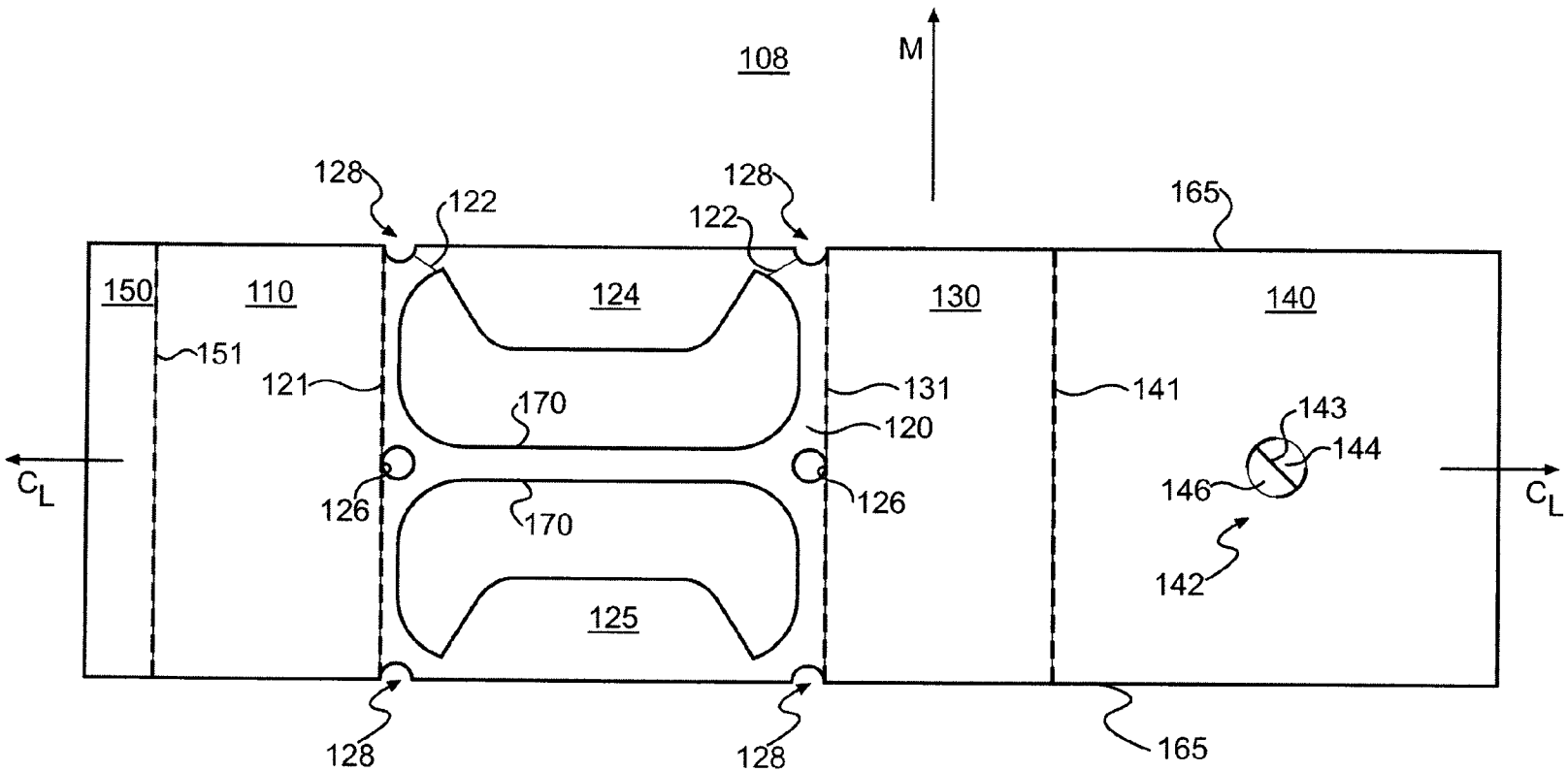
FIG. 3 is a plan view of a blank used to form a package according to a second embodiment of the disclosure.

FIG. 3 is a plan view of the exterior or printed side of a blank 108 used to form a carton 195 according to a second embodiment of the present disclosure. The carton 195 accommodates eight containers C to form a package 200 (illustrated in FIG. 4). The package 200 accommodates the containers C in a 2×2×2 arrangement, including two rows and two columns of containers C, with the containers arranged in an upper and a lower tier. The blank 108 may be partially symmetric about the longitudinal center line $C_L$.

The blank 108 comprises a first side panel 110 foldably connected to a bottom panel 120 at a first transverse fold line 121, a second side panel 130 foldably connected to the bottom panel 120 at a second transverse fold line 131, and a top panel 140 foldably connected to the second side panel 130 at a third transverse fold line 141. An adhesive panel 150 may be foldably connected to the first side panel 110 at a fourth transverse fold line 151.

The bottom panel 120 includes a pair of receiving apertures 170. Each receiving aperture 170 is shaped and sized to receive one or more articles such as containers C (illustrated in FIG. 4) that are to be accommodated within the carton 195. In the exemplary embodiment, each receiving aperture 170 is sized to receive two containers C, which may be connected to one another. A first pivot panel 124 is defined in the bottom panel 120. The first pivot panel 124 is defined in part by the cutout step used to form the adjacent receiving aperture 170, and by oblique lines of disruption 122 extending to the edges of the blank 108. The oblique lines of disruption 122 facilitate folding or bending of the blank, and may be crease lines, cut/creases, or other forms of disruption in the blank 108. A second pivot panel 125 may be defined adjacent to the other receiving aperture 170. The first and second pivot panels 124, 125 are pivotable or hinged with respect to a remainder of the bottom panel 20 to facilitate loading of containers in the blank 8.

One or more locating apertures 126 may be formed in the interior of the blank 108, and one or more locating apertures 128 may be formed along one or more edges of the blank 8. When the blank 108 is incorporated as part of a continuous series of blanks adjacent and/or breachably joined end-to-end at their edges 165, each locating aperture 128 will comprise one half of a full circular aperture. A brace 142 may be formed in the top panel 140. The brace 142 may include opposed brace flaps 144, 146 separated by a breachable line of disruption 143. During erection, the brace flaps 144, 146 may be pressed down into the carton interior to press against and further secure the containers C within the package 200.

Figure 4:
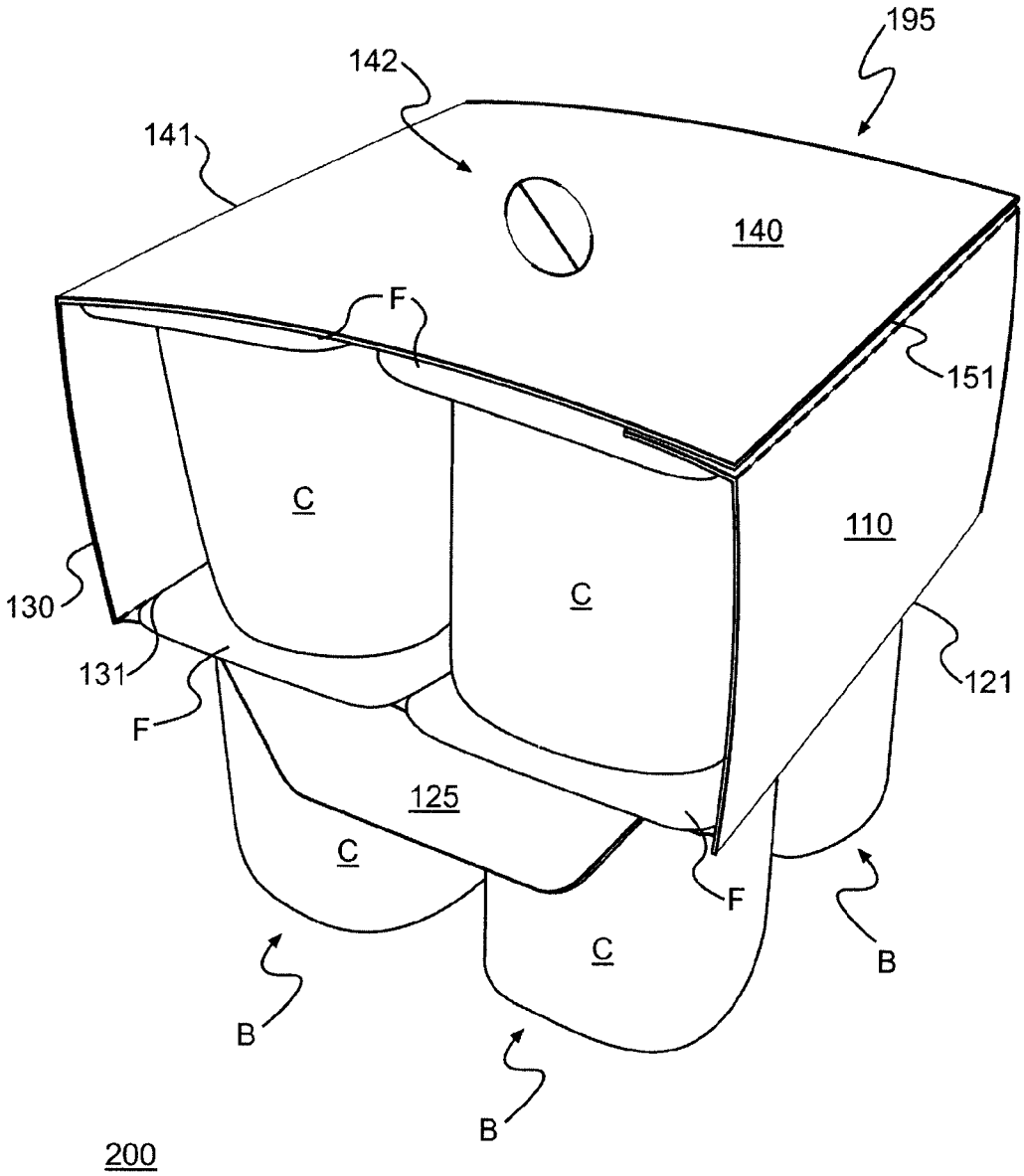
FIG. 4 illustrates the second package embodiment.

FIG. 4 illustrates eight containers C accommodated within the erected carton 195 in a 2×2×2 arrangement, forming the package 200. The containers C are arranged in an upper tier and a lower tier, with two containers in each row and two containers in each column. Generally described, the package 200 is erected by dropping the base portions B of four containers C, two in each aperture 170, down through the receiving apertures 170 until flange portions F of the containers C engage and are supported by the bottom panel 120. As an alternative to dropping the base portions B into the receiving apertures 170, the blank 108 may be raised up to engage the base portions B with the apertures 170. The flange portions F of the containers C may be interconnected. Dropping the base portions B through the apertures 170 pivots the pivot panels 124, 125 outwardly so that they extend generally downwardly and abut the base portions B of the containers C. The oblique lines of disruption 122 (shown in FIG. 3) facilitate pivoting of the panel 124. The pivot panels 124, 125 may also be pivoted downwardly prior to inserting the container C. Four interconnected containers C may either be subsequently or previously stacked on top of the four containers in the bottom tier of containers C. The blank 108 is then folded about the transverse fold lines 121, 131 to bring the first and second side panels 110, 130 upward into generally upright positions. The adhesive panel 150 is folded about the transverse fold line 151 over the top of one row of containers C, and the top panel 140 is folded about the transverse fold line 141 to bring the top panel 140 into contact with the adhesive panel 150. The underside of the top panel 140 may then be adhered or otherwise secured to the adhesive panel 150. If desired, the blank 108 may be wrapped relatively tightly around the containers C to minimize movement of the containers C within the carton 195. The resulting package 200 securely retains the eight containers C.

Referring back to FIG. 3, during packaging operations, the blank 108 may be one of a series of similar or identical blanks that are adjacent to one another and/or breachably attached end-to-end at the end edges 165. The series of blanks 108 moves through a packaging machine in the machine direction or direction of travel indicated by the arrow M. In the illustrated embodiment, the blank 108 is designed to accommodate eight containers C. The blank 108 may be, for example, adapted so that it can accommodate more than two rows of containers C. For example, two of the blanks 108 can effectively be joined at end edges 165 to form a blank accommodating four rows of containers C in a 4×2×2 arrangement.

When in the downwardly extending position shown in FIG. 4, the pivot panels 124, 125 offer "billboard" area upon which advertising, product, and other information may be printed. If desired, either or both of the pivot panels 124, 125 may be torn away from the carton 195 in order to facilitate opening of the package 200. The downwardly extending pivot panels 124, 125 press against the sides of the containers C to further secure the containers in the bottom tier of containers, and increase the overall rigidity of the package.

Figure 5:
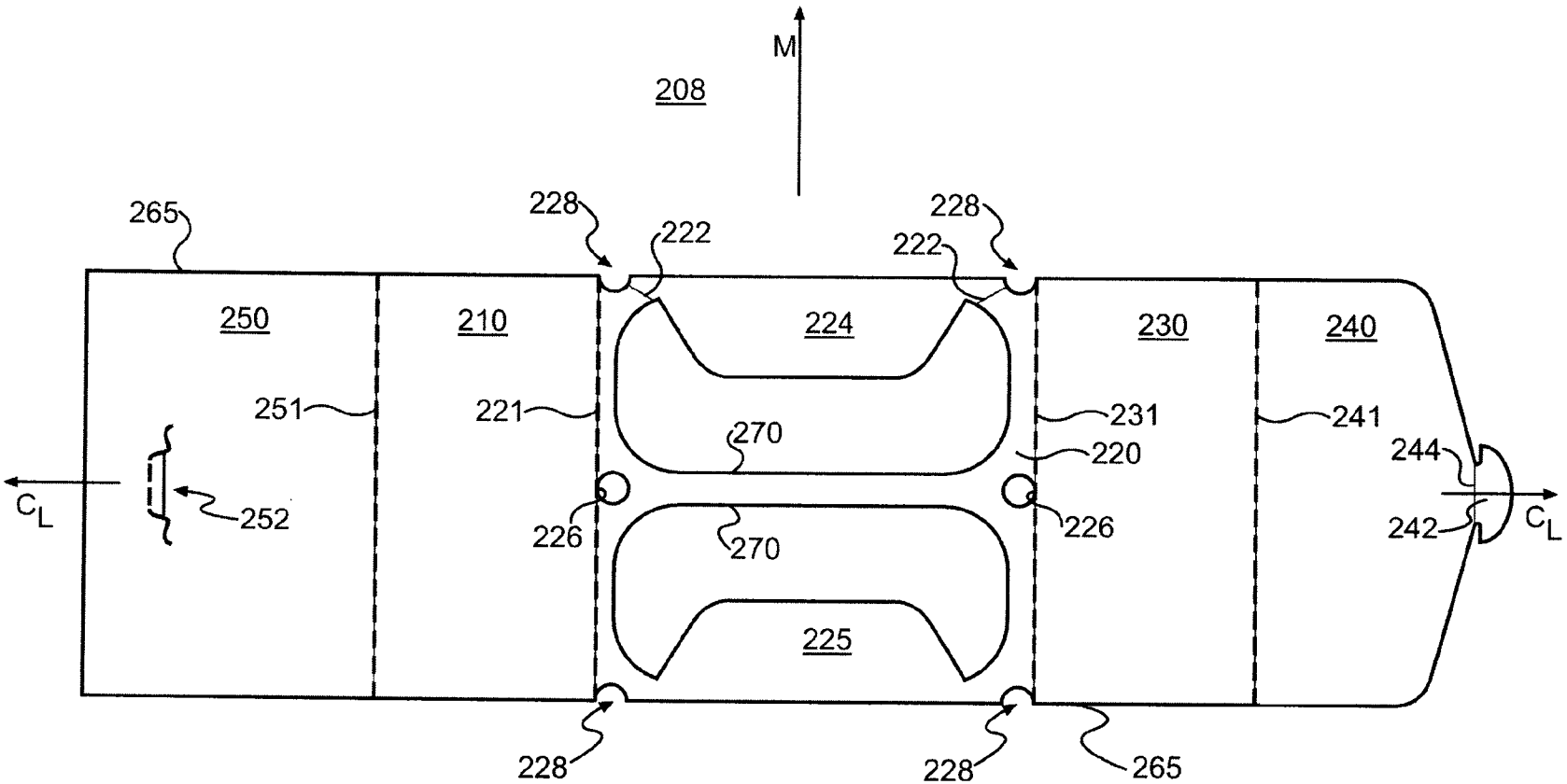
FIG. 5 is a plan view of a blank used to form a package according to a third embodiment of the disclosure.

FIG. 5 is a plan view of the exterior or printed side of a blank 208 used to form a carton 295 according to a third embodiment of the present disclosure. The carton 295 accommodates eight containers C to form a package 300 (illustrated in FIG. 6). The package 300 accommodates the containers C in a 2×2×2 arrangement, including two rows and two columns of containers C, which are arranged in an upper and a lower tier. The blank 208 may be partially symmetric about the longitudinal center line $C_L$.

The blank 208 comprises a first side panel 210 foldably connected to a bottom panel 220 at a first transverse fold line 221, a second side panel 230 foldably connected to the bottom panel 220 at a second transverse fold line 231, a first top panel 240 foldably connected to the second side panel 230 at a third transverse fold line 241, and a second top panel 250 foldably connected to the first side panel 210 at a fourth transverse fold line 251.

The bottom panel 220 includes a pair of receiving apertures 270. Each receiving aperture 270 is shaped and sized to receive one or more containers C (illustrated in FIG. 6) that are to be accommodated within the carton 295. In the exemplary illustrated embodiment, each receiving aperture 270 is sized to receive two containers C. A first pivot panel 224 is defined in the bottom panel 220. The first pivot panel 224 is defined in part by the cut used to form the adjacent receiving aperture 270, and by oblique lines of disruption 222 extending to the edges of the blank 208. A second pivot panel 225 may be defined adjacent to the other receiving aperture 270. One or more locating apertures 226 may be formed in the interior of the blank 208, and one or more locating apertures 228 may be formed along one or more end edges of the blank 208. When the blank 208 is incorporated as part of a continuous series of blanks adjacent and/or breachably joined at their edges 265, each aperture 228 will comprise one half of a full circular aperture.

The first top panel 240 includes a locking projection 242 extending from a distal edge of the panel 240. The locking projection 242 is hingedly connected to the top panel 240 at a crease line 244. The second top panel 250 includes a locking aperture 252 sized to receive and secure the locking projection 242 therein. During erection, the locking projection 242 may extend into the carton interior and press against one or more containers C. The projection 242 may therefore serve to further secure the containers C within the package 300.

Figure 6:
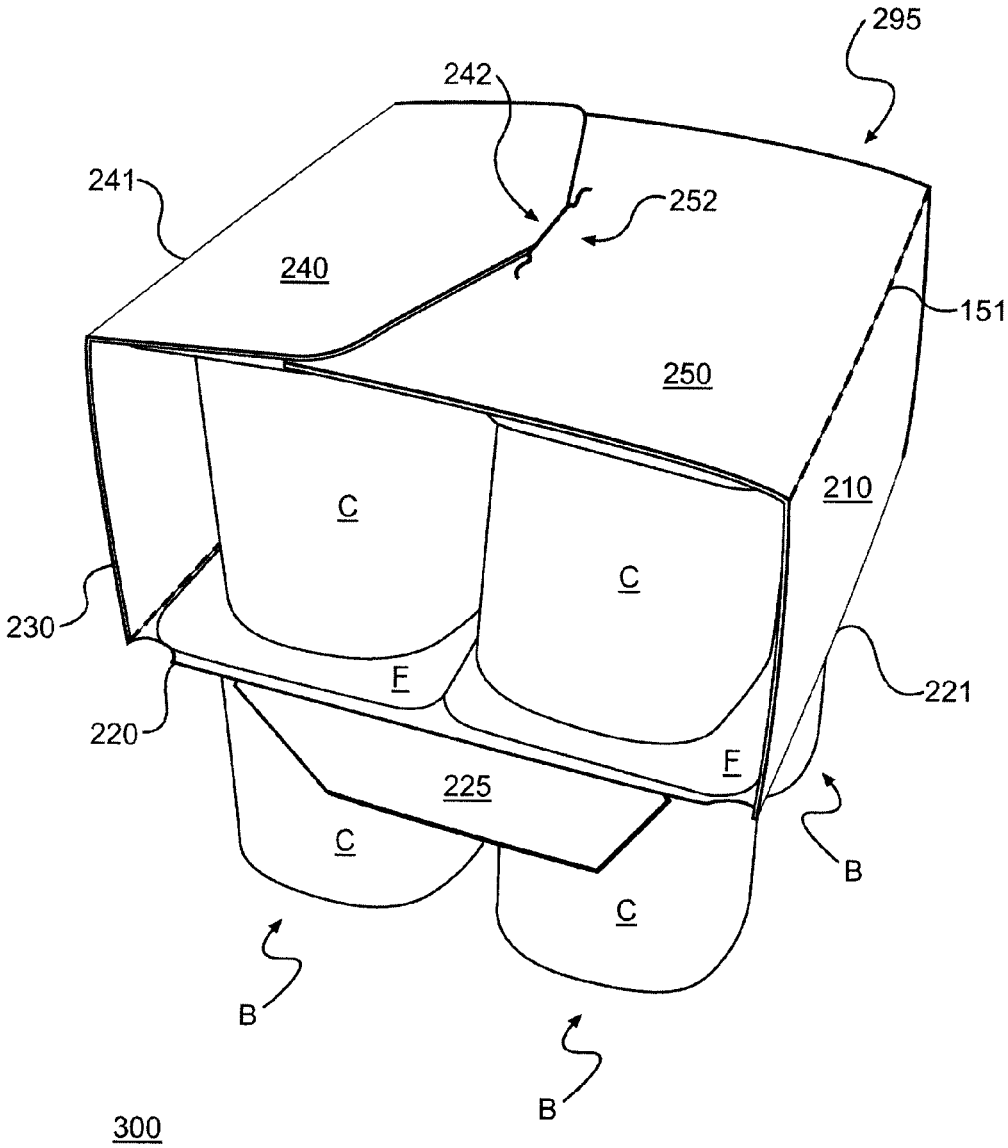
FIG. 6 illustrates the third package embodiment.

FIG. 6 illustrates eight containers C accommodated within the erected carton 295, forming the package 300. Generally described, the package 300 is erected by engaging the base portions B of four containers C, two in each receiving aperture 270, with the receiving apertures 270 until flange portions F of the containers C engage and are supported by the bottom panel 220. The flanges F of the containers C may be interconnected. Moving the base portions B through the receiving apertures 270 pushes the pivot panels 224, 225 outwardly and downwardly. The pivot panels 224, 225 may also be pivoted downwardly prior to inserting the container C. Four containers C may either be subsequently or previously stacked on top of the four containers in the bottom tier of containers C. The blank 208 is then folded about the transverse fold lines 221, 231 to bring the first and second side panels 210, 230 upward into generally upright positions. The first top panel 240 is folded about the transverse fold line 241 and the second top panel 250 is folded about the fold line 251 so that the locking projection 242 can be pressed into the locking aperture 252. The locking projection 242 can be pressed through the aperture 252 such that the projection 242 presses against one or more containers C in the top tier of containers. If desired, the blank 208 may be wrapped relatively tightly around the containers C to minimize movement of the containers C within the carton 295. The resulting package 300 securely retains the eight containers C.

The pivot panels 224, 225 offer billboard area upon which advertising, product, nutritional, and other information may be printed. If desired, either or both of the pivot panels 224, 225 may be torn away from the carton 295 in order to facilitate opening of the package 200. The downwardly extending pivot panels 224, 225 press against the sides of the containers C to further secure the containers in the bottom tier and increase the overall rigidity of the package.

Figure 7:
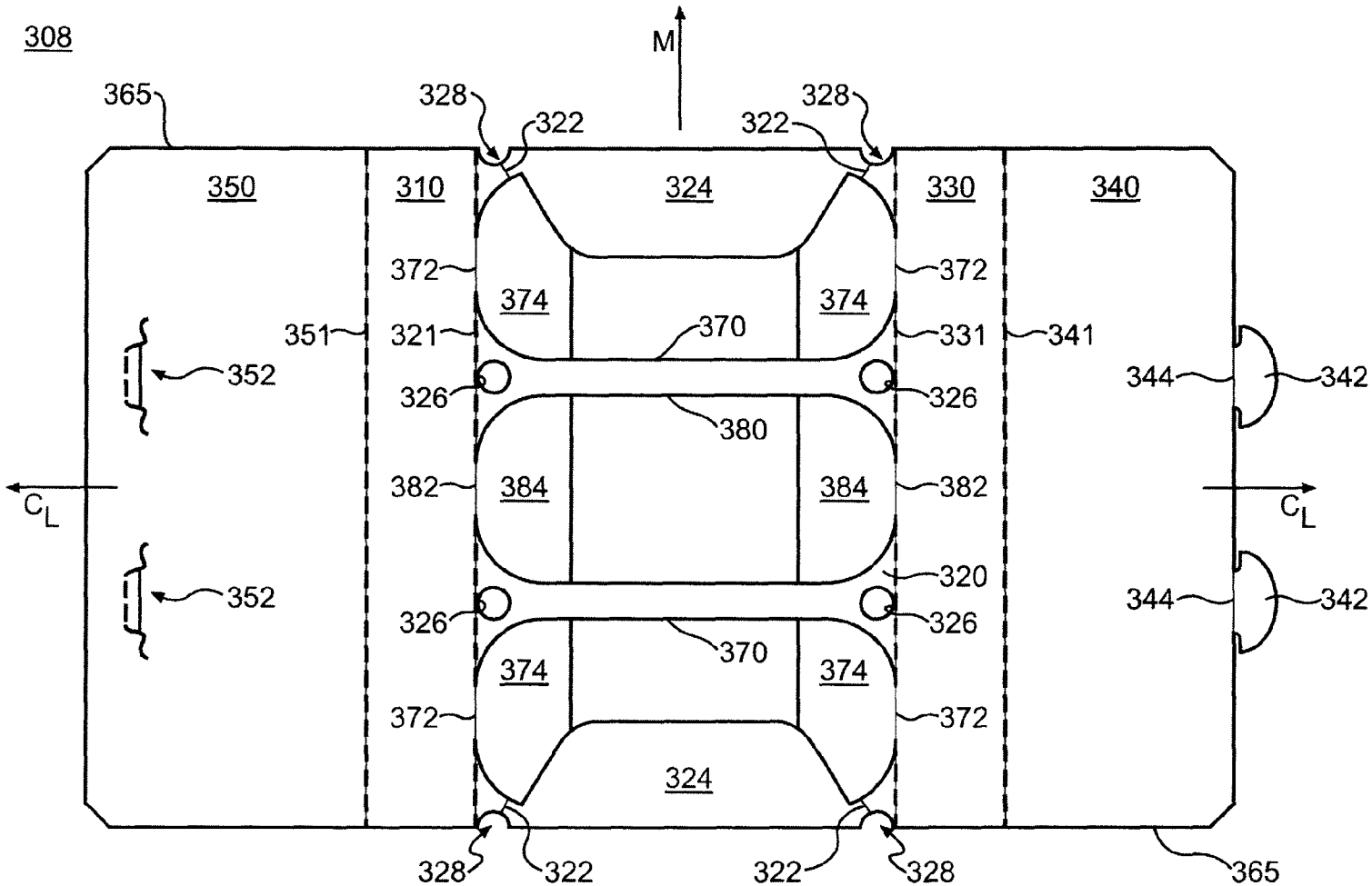
FIG. 7 is a plan view of a blank used to form a package according to a fourth embodiment of the disclosure.

FIG. 7 is a plan view of the exterior or printed side of a blank 308 used to form a carton 395 according to a fourth embodiment of the present disclosure. The carton 395 accommodates six containers C to form a package 400 (illustrated in FIG. 9). The package 400 accommodates the containers C in a 3×2×1 arrangement, including three rows and two columns of containers C, which are arranged in a single tier. The blank 308 may be symmetric about the longitudinal center line $C_L$.

The blank 308 comprises a first side panel 310 foldably connected to a bottom panel 320 at a first transverse fold line 321, a second side panel 330 foldably connected to the bottom panel 320 at a second transverse fold line 331, a first top panel 340 foldably connected to the second side panel 330 at a third transverse fold line 341, and a second top panel 350 foldably connected to the first side panel 310 at a fourth transverse fold line 351.

The bottom panel 320 includes a pair of outer receiving apertures 370. Each outer receiving aperture 370 is shaped and sized to receive one or more containers C (illustrated in FIG. 9) that are to be accommodated within the carton 395. In the exemplary embodiment, each receiving aperture 370 is sized to receive two containers C. A pivot panel 324 is defined at each end of the blank 308. Each pivot panel 324 is defined in part by the cut used to form the adjacent receiving aperture 370, and by oblique lines of disruption 322 extending to the edges of the blank 308. Brace panels 374 connected at fold or hinge lines 372 are defined at each side of each aperture 370. A third, central receiving aperture 380 is defined between the outer receiving apertures 370. The central third receiving aperture 380 is sized to receive two containers C. Brace panels 384 connected at fold or hinge lines 382 are defined at each side of the aperture 380. One or more locating apertures 326 may be formed in the interior of the blank 308, and one or more locating apertures 328 may be formed along one or more edges of the blank 308. When the blank 308 is incorporated as part of a continuous series of blanks adjacent and/or breachably joined end-to-end at their edges 365, each aperture 328 will comprise one half of a full circular aperture.

The first top panel 340 includes a pair of locking projections 342 extending from a distal edge of the panel 340. The locking projections 342 are hingedly connected to the top panel 340 at transverse fold lines 344. The second top panel 350 includes a pair of locking apertures 352, each locking aperture 352 being sized to receive and secure a locking projection 342 therein. During erection, the locking projections 342 may extend into the carton interior and press against one or more containers C. The locking projections 342 may therefore serve to further secure the containers within the package 400.

Figure 8:
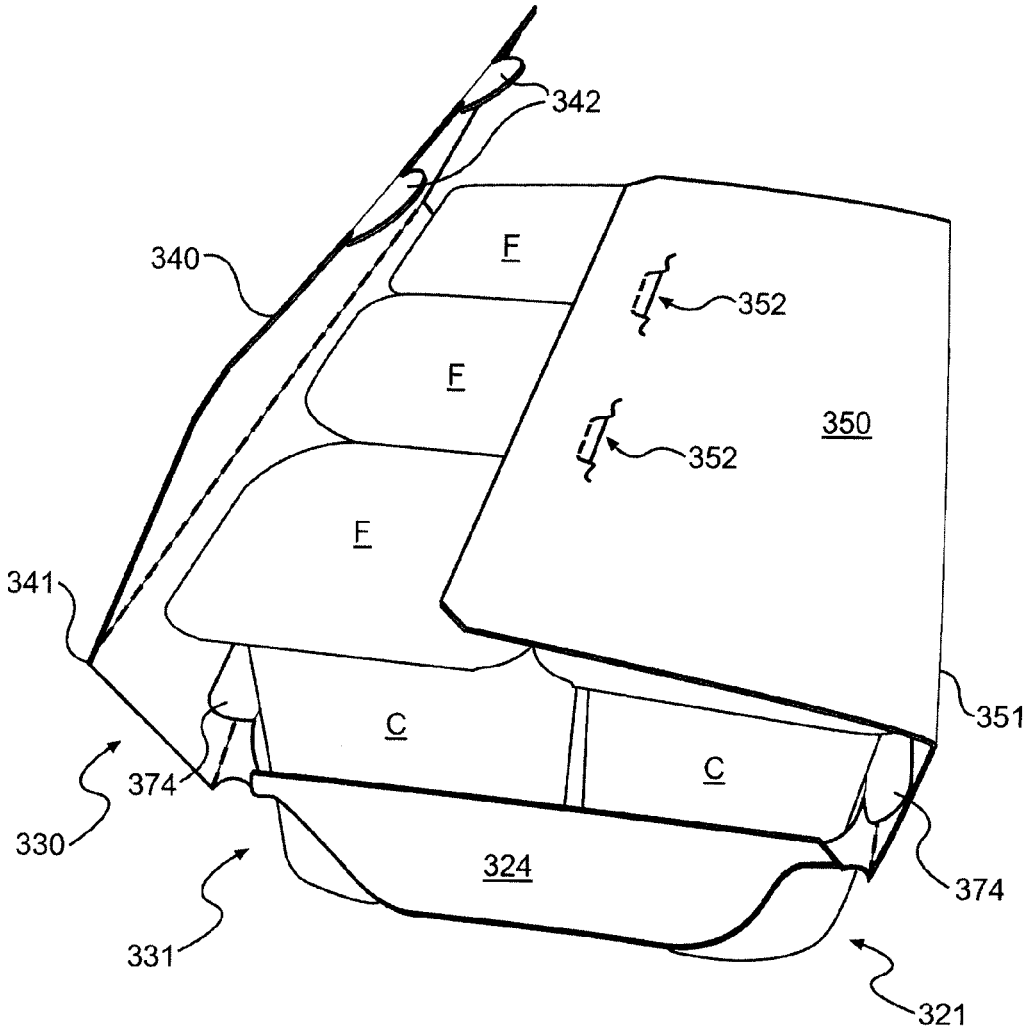
FIG. 8 illustrates erection of the fourth package embodiment.
Figure 9:
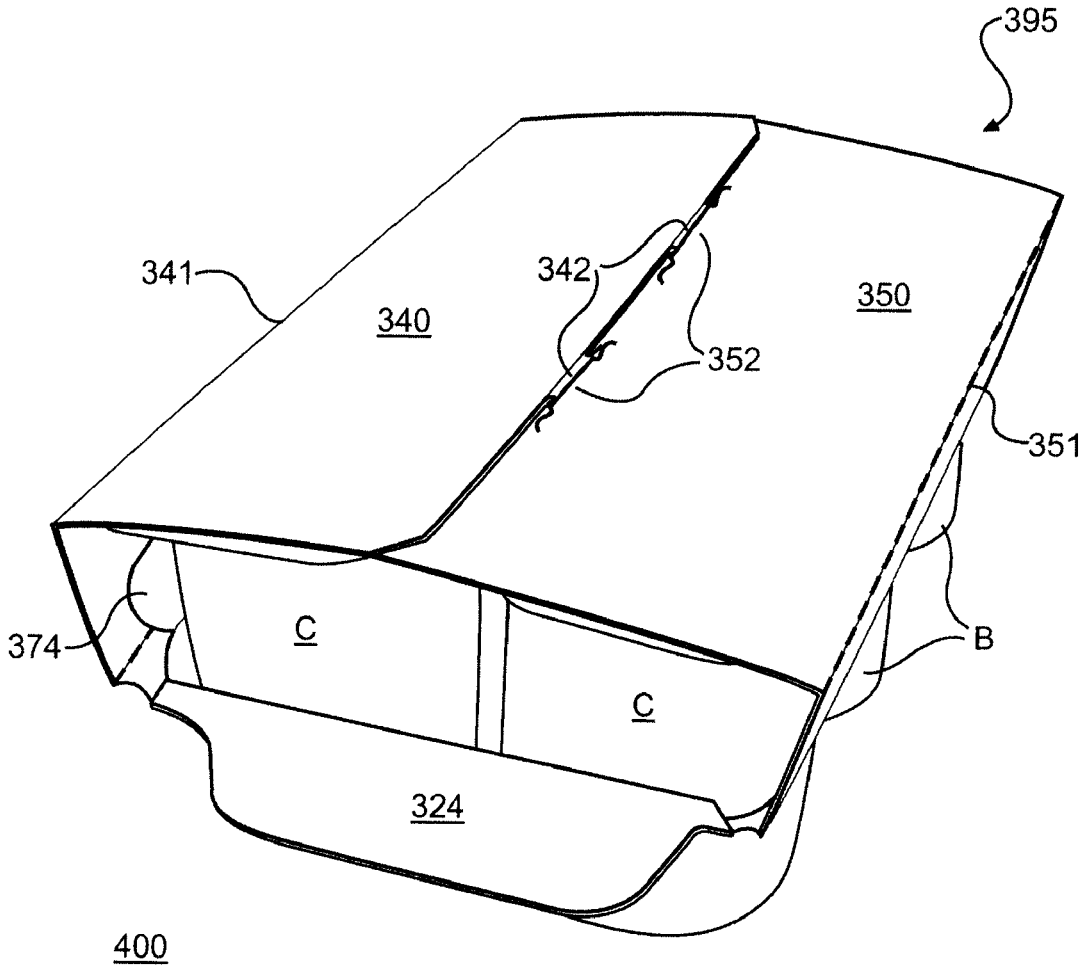
FIG. 9 illustrates the fourth package embodiment.

FIG. 8 illustrates an erection step of the package 400. Generally described, the package 400 is erected by pivoting the brace panels 374, 384 (shown in FIG. 7) generally upwardly from the bottom panel 320. Base portions B of six containers C, two in each aperture 370, and two in the aperture 380, are then passed through the apertures 370, 380. The flanges F of the containers C may be interconnected. As the containers C pass through the apertures 370, the pivot panels 324 are pivoted outwardly and downwardly so that they extend generally downwardly and across the ends of the package. The pivot panels 324 may also be pivoted downwardly prior to inserting the bases of the containers C. The pivot panels 324 abut base portions B of the containers C located at the ends of the package 400. The brace panels 374, 384 (the interior brace panels 384 are not visible in FIG. 8) extend generally upright and press against the sides of adjacent containers C, preventing the panel 320 from rising up in relation to the containers C. The brace panels 374, 384 may also abut undersides of flanges F of the containers C. The blank 308 is then folded about the transverse fold lines 321, 331 to bring the side panels 310, 330 upward into generally upright positions. The first top panel 340 is folded about the transverse fold line 341 and the second top panel 350 is folded about the transverse fold line 351 so that each locking projection 342 can be pressed into a corresponding locking aperture 352, as shown in FIG. 9. The locking projections 342 can be pressed through the apertures 352, for example, such that the projections 342 engage or abut the flanges F of one or more of the containers C.

FIG. 9 illustrates the erected package 400 according to the fourth embodiment of the disclosure. If desired, the blank 308 may be wrapped relatively tightly around the containers C to minimize movement of the containers C within the carton 395. The resulting package 400 securely retains the containers C. When in the downwardly extending position shown in FIG. 4, the pivot panels 324 at the ends of the package 400 offer billboard area upon which advertising, product, and other information may be printed. If desired, either or both of the pivot panels 324 may be torn away from the carton 395 in order to facilitate opening of the package 400.

Figure 10:
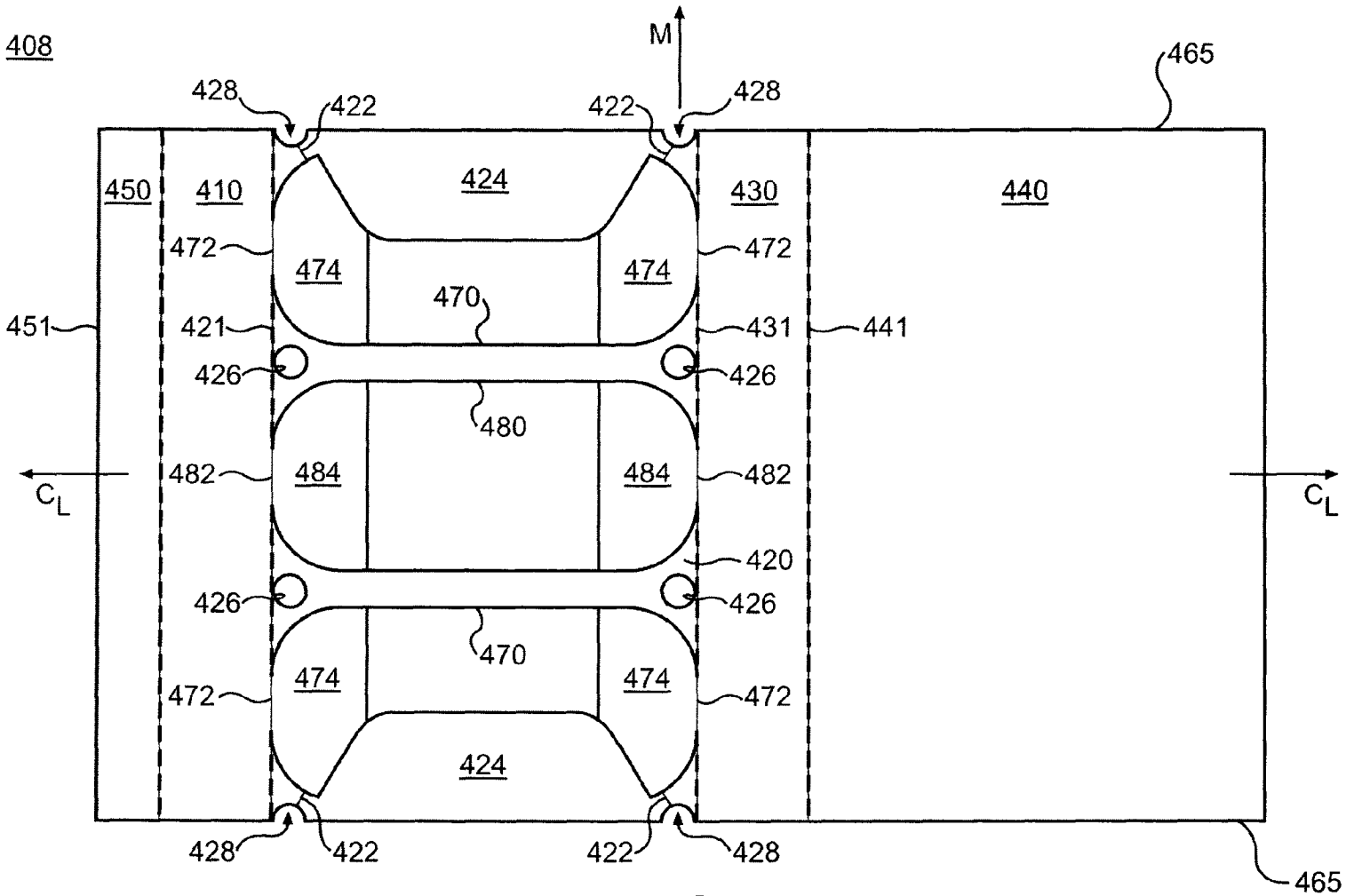
FIG. 10 is a plan view of a blank used to form a package according to a fifth embodiment of the disclosure.

FIG. 10 is a plan view of the exterior or printed side of a blank 408 used to form a carton 495 according to a fifth embodiment of the present disclosure. The carton 495 accommodates six containers C to form a package 500 (illustrated in FIG. 11). The package 500 accommodates the containers C in a 3×2×1 arrangement, including three rows and two columns of containers C, which are arranged in a single tier. The blank 408 is similar to the blank 308 illustrated in FIG. 7, and like reference numbers in FIG. 7 and FIG. 10 indicate like or identical elements, with the reference numbers in FIGS. 10 and 11 beginning with "4" or "5." The blank 408 may be symmetric about the longitudinal center line $C_L$.

Figure 11:
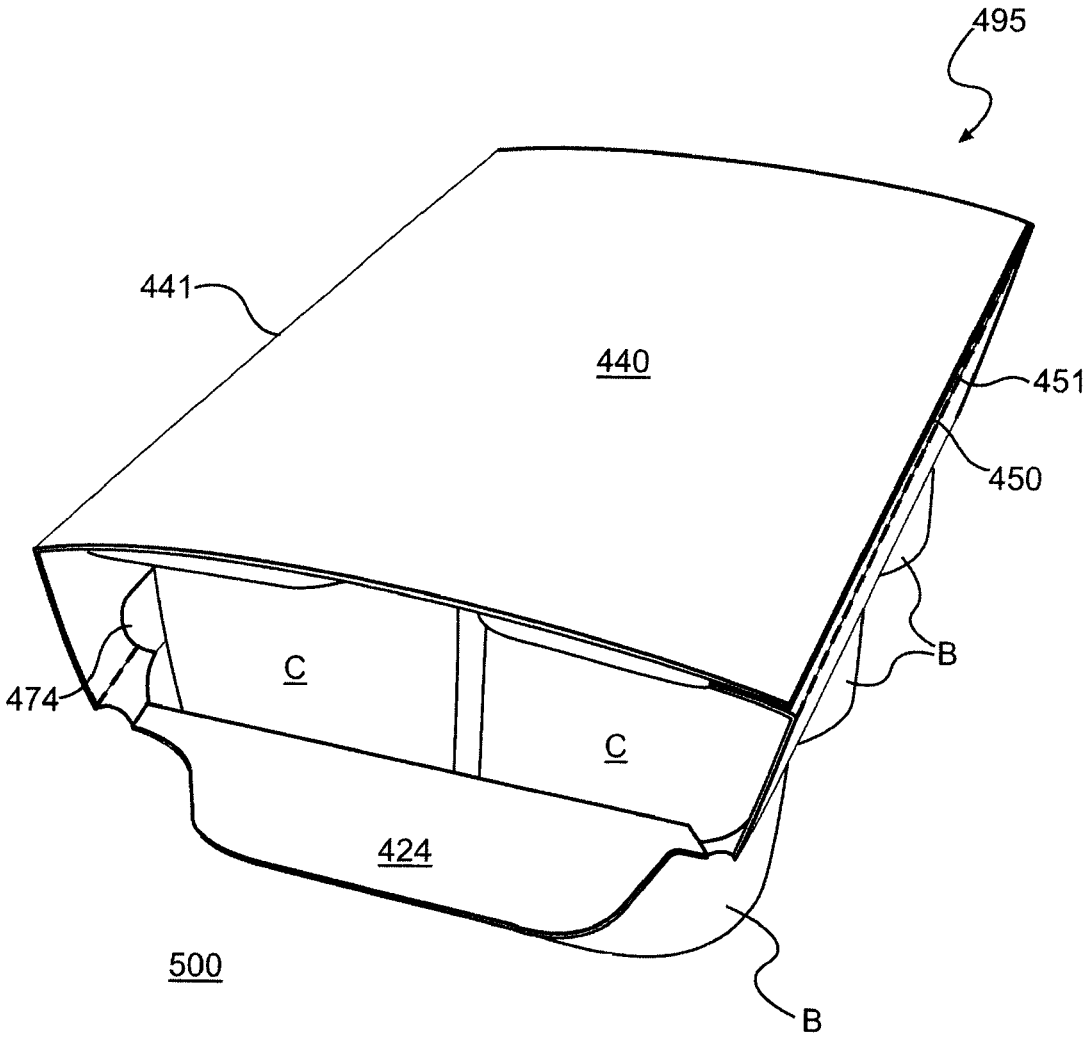
FIG. 11 illustrates the fifth package embodiment.

The blank 408 differs from the blank 308 in one aspect in that rather than two top panels, the blank 408 includes a top panel 440 and an adhesive panel 450. The blank 408 may be constructed into a package in a manner similar to the blank 308 (FIG. 7), except that rather than engaging locking projections with locking apertures to close the top of the package, the top panel 440 is adhered or otherwise secured to the adhesive panel 450. FIG. 11 illustrates the erected package 500.

Figure 12:
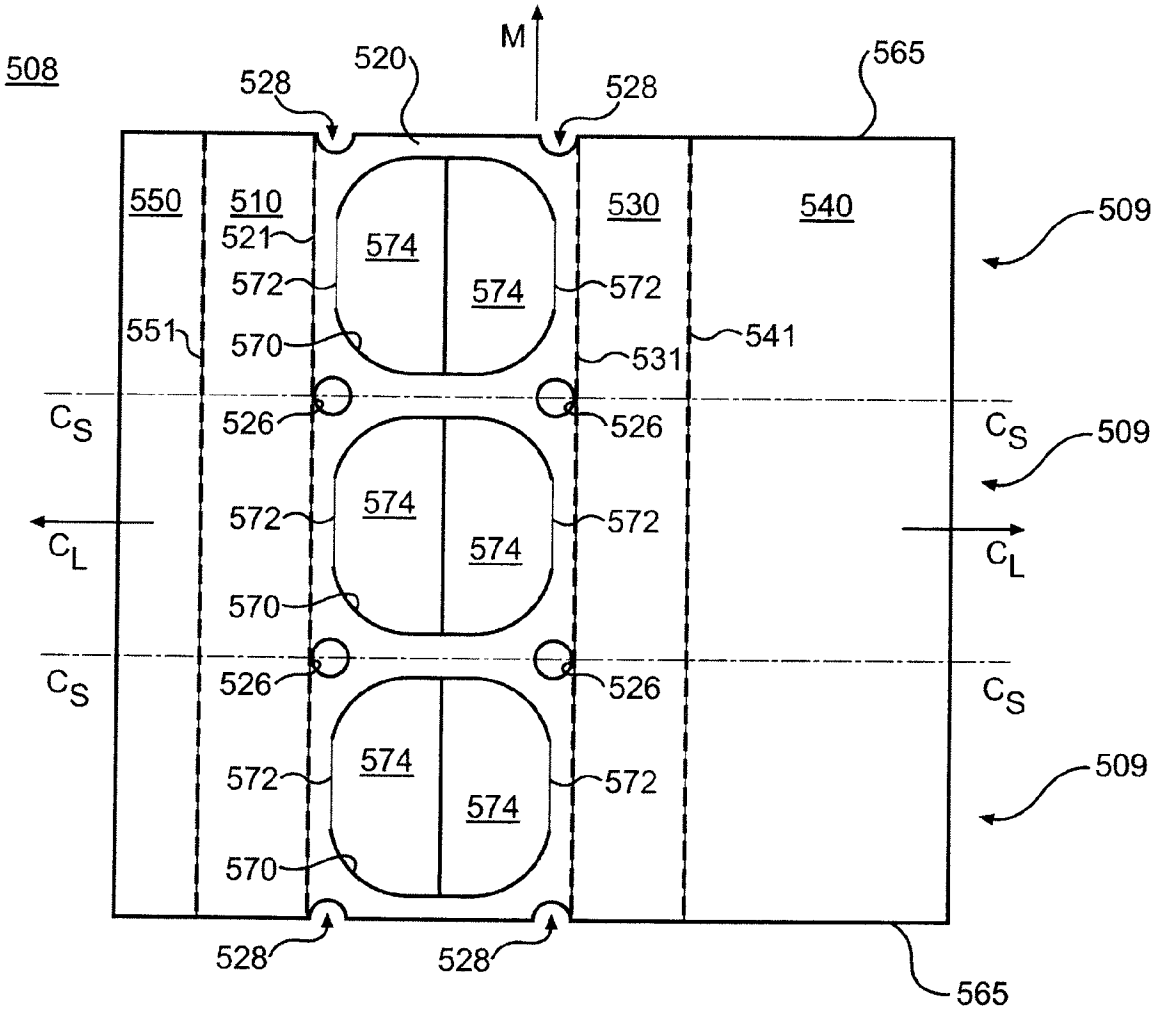
FIG. 12 is a plan view of a blank used to form a package according to a sixth embodiment of the disclosure.

FIG. 12 is a plan view of the exterior or printed side of a blank 508 used to form a carton 595 according to a sixth embodiment of the disclosure. The carton 595 accommodates three containers C to form a package 600 (illustrated in FIG. 13). The package 600 accommodates three containers C in a 3×1×1 arrangement, including three rows and one column of containers C, which are arranged in a single tier. The blank 508 may be symmetric about the longitudinal center line $C_L$.

The blank 508 comprises a first side panel 510 foldably connected to a bottom panel 520 at a first transverse fold line 521, a second side panel 530 foldably connected to the bottom panel 520 at a second transverse fold line 531, a top panel 540 foldably connected to the second side panel 530 at a third transverse fold line 541, and an adhesive panel 550 foldably connected to the first side panel 510 at a fourth transverse fold line 551.

The bottom panel 520 includes a row of three receiving apertures 570. Each receiving aperture 570 is shaped and sized to receive one or more containers C (illustrated in FIG. 13) that is to be accommodated within the carton 595. A brace panel 574 connected at a fold or hinge line 572 is defined at each side of each receiving aperture 570. One or more locating apertures 526 may be formed in the interior of the blank 508, and one or more locating apertures 528 may be formed along one or more edges of the blank 508. When the blank 508 is incorporated as part of a continuous series of blanks adjacent and/or breachably joined end-to-end at their edges 565, each aperture 528 will comprise one half of a full circular aperture.

Figure 13:
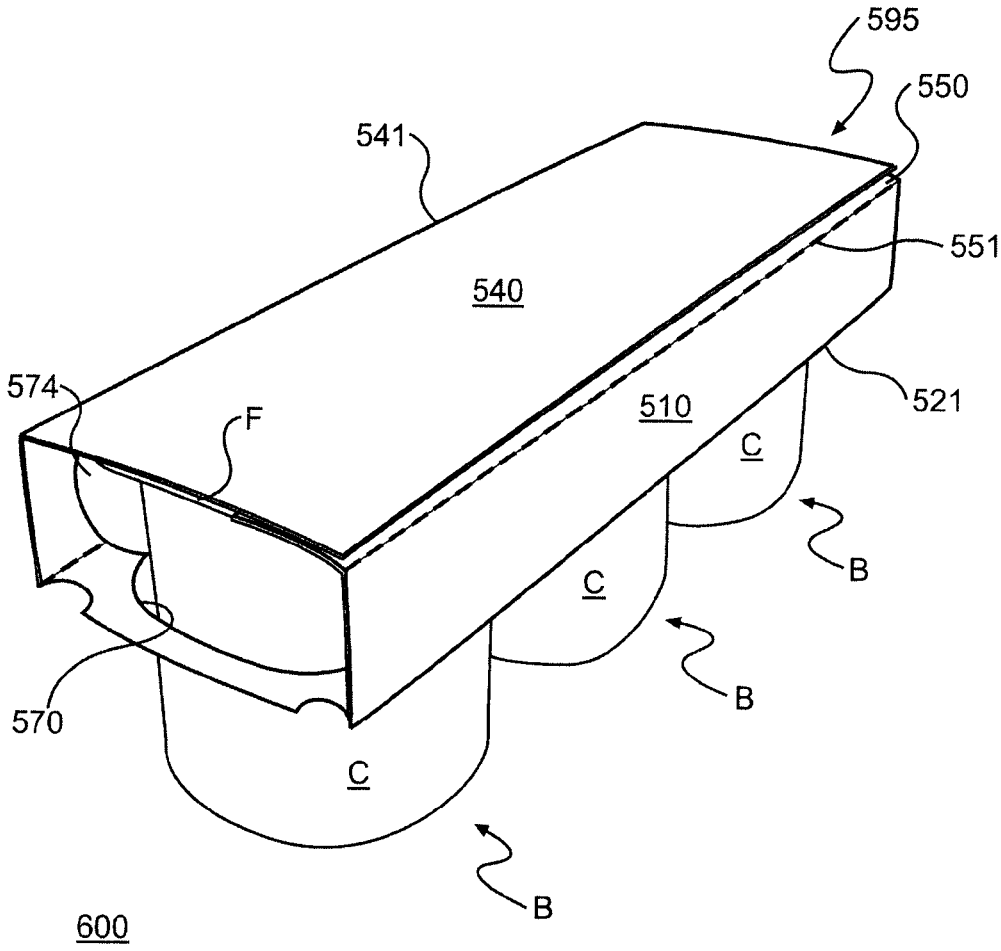
FIG. 13 illustrates the sixth package embodiment.

Generally described, the package 600 is erected by pivoting the brace panels 574 upwardly. Base portions B of three containers C, one in each aperture 570, are then passed downwardly through the apertures 570. The brace panels 574 extend generally upright and press against the sides of adjacent containers C. The brace panels 574 may also abut undersides of flanges F of the containers C. The container flanges F may be interconnected. The blank 508 is then folded about the transverse fold lines 521, 531 to bring the side panels 510, 530 upward into generally upright positions. The first top panel 540 is folded about the transverse fold line 541 and the adhesive panel 550 is folded about the transverse fold line 551 so that the panels 540, 550 can be adhered together. FIG. 13 illustrates the erected package 600. The brace panels 574, which abut the undersides of the container flanges F, may serve to prevent the containers C from falling downwardly through the apertures 570. One or more of the brace panels 574 may optionally be pivoted downwardly by insertion of the containers C so that they abut the sides of an adjacent container C. Billboard area may therefore be provided below the bottom panel 520.

Referring back to FIG. 12, according to one aspect of the disclosure, the blank 508 is comprised of three sections 509 divided along the longitudinal lines $C_S$. Any number of the sections 509 can be arranged end-to-end to form a blank from which a package can be formed that accommodates any desired number of containers C. For example, if the blank 508 is breached along each line $C_S$, each individual section 509 can form a package accommodating one container C. Ten of the sections 509, for example, can be connected end-to-end to form a package accommodating ten containers C, etc. The ability to vary the number of rows of apertures in the resultant blank allows packages with varying numbers of containers to be constructed with minimal adjustment to packaging machinery. Any of the longitudinal lines of disruption $C_S$ may be, for example, a breachable line of disruption.

Figure 14:
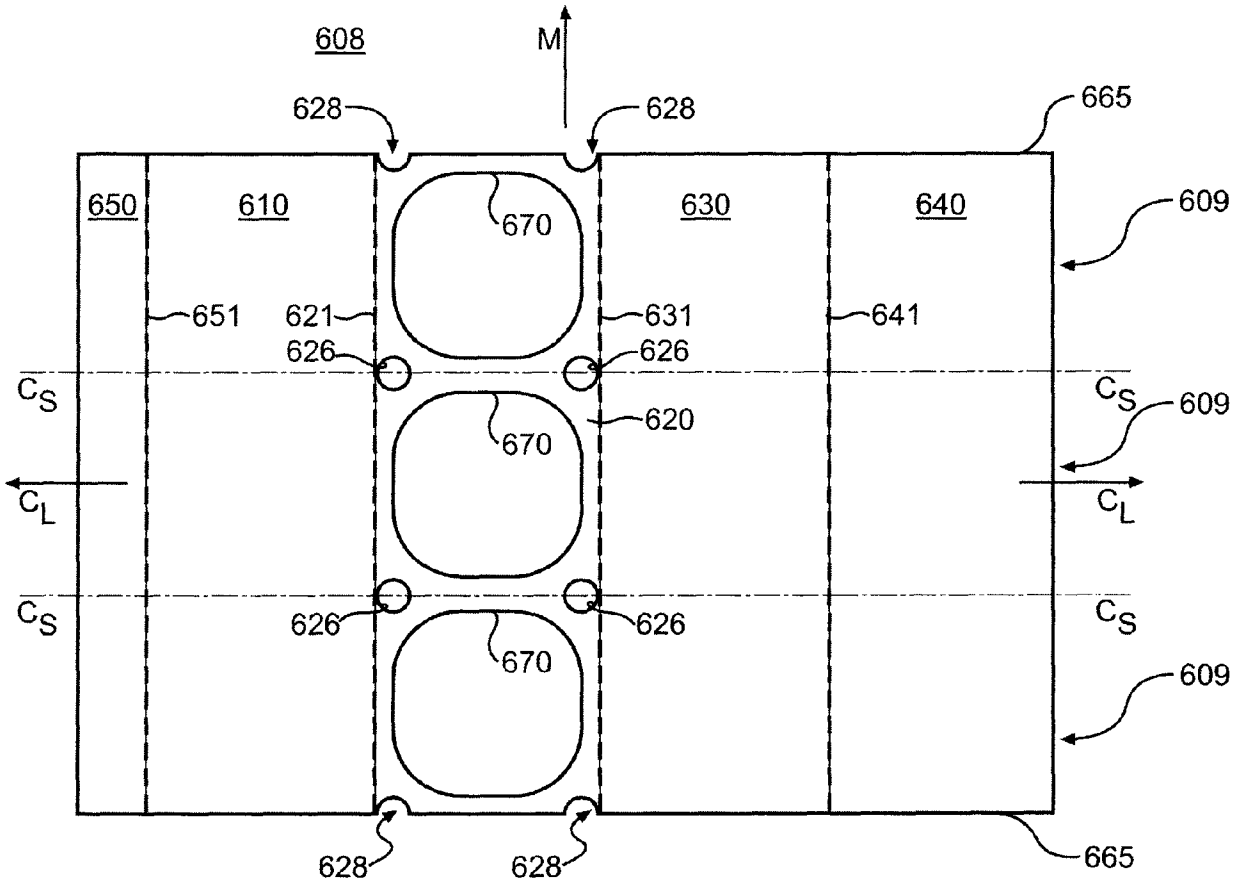
FIG. 14 is a plan view of a blank used to form a package according to a seventh embodiment of the disclosure.

FIG. 14 is a plan view of the exterior or printed side of a blank 608 used to form a carton 695 according to a seventh embodiment of the present disclosure. The carton 695 accommodates six containers C to form a package 700 (illustrated in FIG. 15). The package 700 accommodates the containers C in a 3×1×2 arrangement, including three rows and one column of containers C, which are arranged in an upper and a lower tier. The blank 608 may be symmetric about the longitudinal center line $C_L$.

The blank 608 comprises a first side panel 610 foldably connected to a bottom panel 620 at a first transverse fold line 621, a second side panel 630 foldably connected to the bottom panel 620 at a second transverse fold line 631, a top panel 640 foldably connected to the second side panel 630 at a third transverse fold line 641, and an adhesive panel 650 foldably connected to the first side panel 610 at a fourth transverse fold line 651.

The bottom panel 620 includes a row of three receiving apertures 670. Each receiving aperture 670 is shaped and sized to receive a container C (illustrated in FIG. 15) that is to be accommodated within the carton 695. One or more locating apertures 626 may be formed in the interior of the blank 608, and one or more locating apertures 628 may be formed along one or more end edges of the blank 608.

Figure 15:
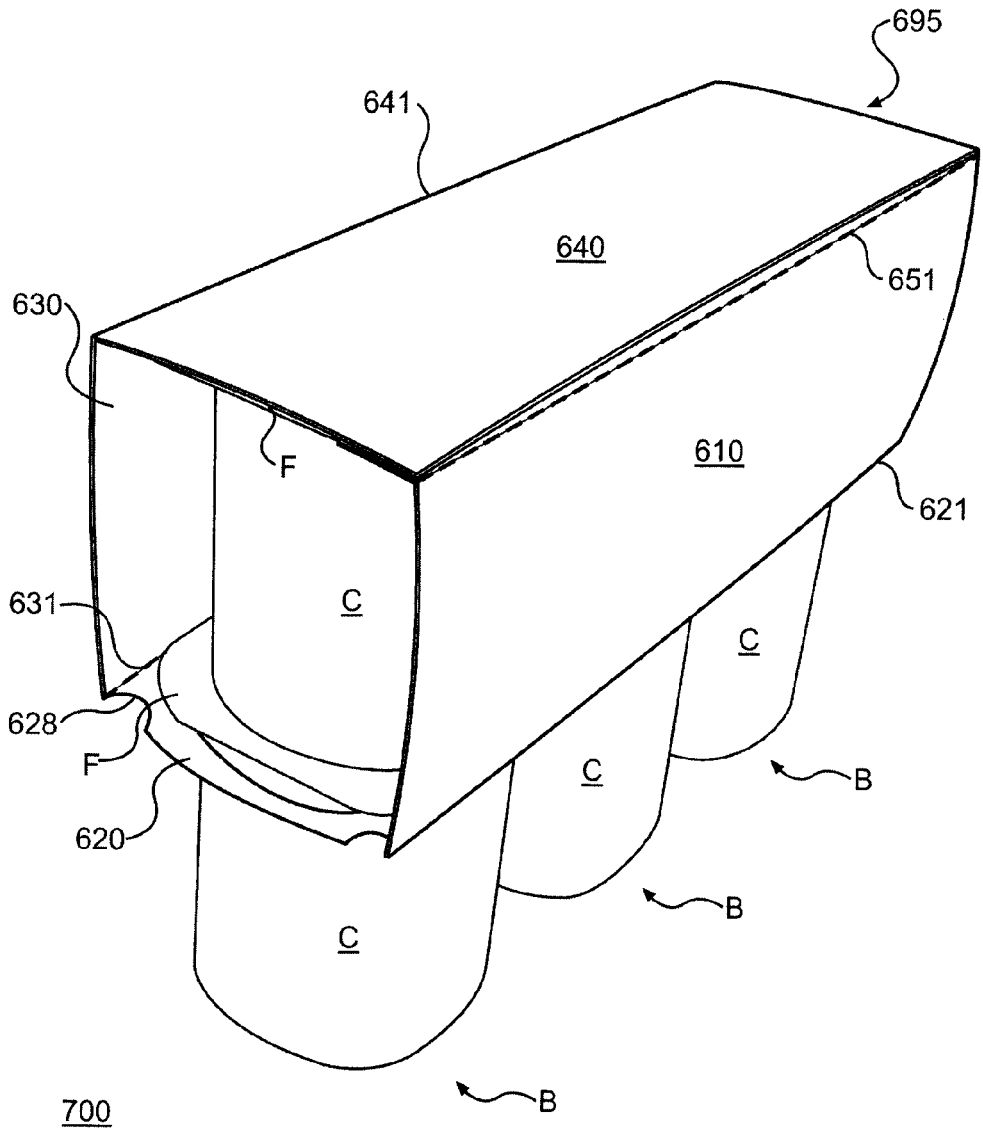
FIG. 15 illustrates the seventh package embodiment.

Generally described, the package 700 is erected by passing base portions B of three containers C, one in each receiving aperture 670, through the apertures 670. The containers C are lowered through the blank 608 until flange portions F of the containers abut and are supported on the bottom panel 620. The flanges F of the containers may be interconnected. Three additional containers C may either be subsequently or previously stacked on top of the three containers in the bottom tier of containers C. The blank 608 is then folded about the transverse fold lines 621, 631 to bring the first and second side panels 610, 630 upward into generally upright positions. The top panel 640 is folded about the transverse fold line 641 and the adhesive panel 650 is folded about the transverse fold line 651 so that the panels 640, 650 can be adhered together. FIG. 15 illustrates the erected package 600.

Referring back to FIG. 14, according to one aspect of the disclosure, the blank 608 is comprised of three sections 609 that may be divided along any of the longitudinal lines $C_S$. Any number of the blank sections 609 can be connected end-to-end to form a blank from which a package can be formed that accommodates any desired number of containers C.

Figure 16:
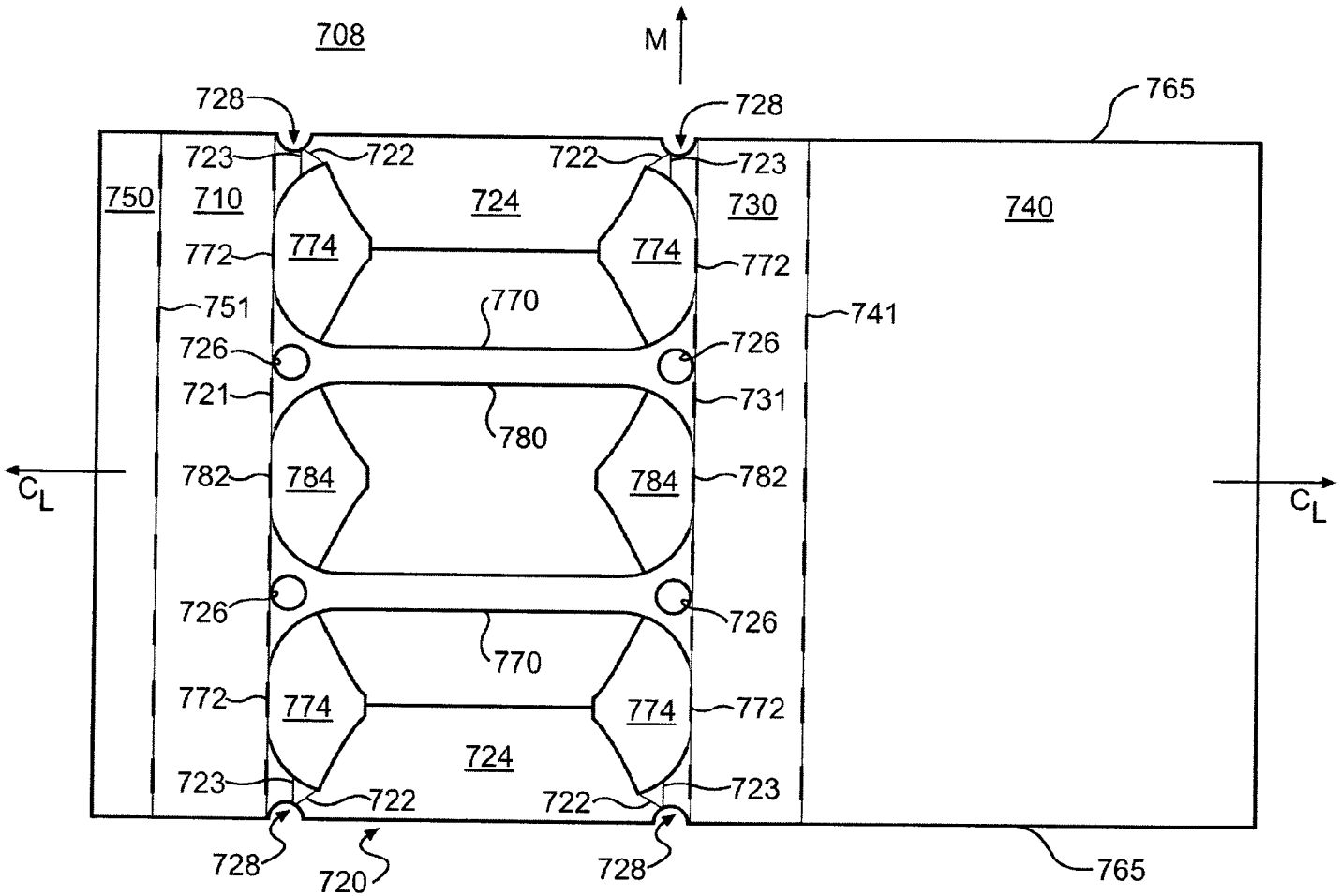
FIG. 16 is a plan view of a blank used to form a package according to an eighth embodiment of the disclosure.

FIG. 16 is a plan view of the exterior or printed side of a blank 708 used to form a carton according to an eighth embodiment of the present disclosure. The carton accommodates six containers C to form a package (not illustrated). The package accommodates the containers C in a 3×2×1 arrangement, including three rows and two columns of containers C, which are arranged in a single tier. The blank 708 may be symmetric about the longitudinal center line $C_L$.

The blank 708 comprises a first side panel 710 foldably connected to a bottom panel 720 at a first transverse fold line 721, a second side panel 730 foldably connected to the bottom panel 720 at a second transverse fold line 731, a first top panel 740 foldably connected to the second side panel 730 at a third transverse fold line 741, and an adhesive panel 750 foldably connected to the first side panel 710 at a fourth transverse fold line 751.

The bottom panel 720 includes a pair of outer receiving apertures 770. Each outer receiving aperture 770 is shaped and sized to receive one or more containers C (not illustrated) that are to be accommodated within the carton. In the exemplary embodiment, each outer receiving aperture 770 is sized to receive two containers C. A pivot panel 724 is defined at each end of the blank 708. Each pivot panel 724 is defined in part by the cut used to form the adjacent receiving aperture 770, and by lines of disruption 722, 723 extending to the edges of the blank 708. Brace panels 774 connected at transverse fold or hinge lines 772 are defined at each side of each aperture 770. A third, central receiving aperture 780 is defined between the two outer receiving apertures 770. The third or central receiving aperture 780 is sized to receive two containers C. Brace panels 784 connected at transverse fold or hinge lines 782 are defined at each side of the central receiving aperture 780. One or more locating apertures 726 may be formed in the interior of the blank 708, and one or more locating apertures 728 may be formed along one or more edges of the blank 708.

The blank 708 may be constructed into a package in a manner similar to the blank 308 (illustrated in FIG. 7), except that rather than engaging locking projections with locking apertures to close the top of the package, the top panel 740 is adhered to the adhesive panel 750.

Figure 17:
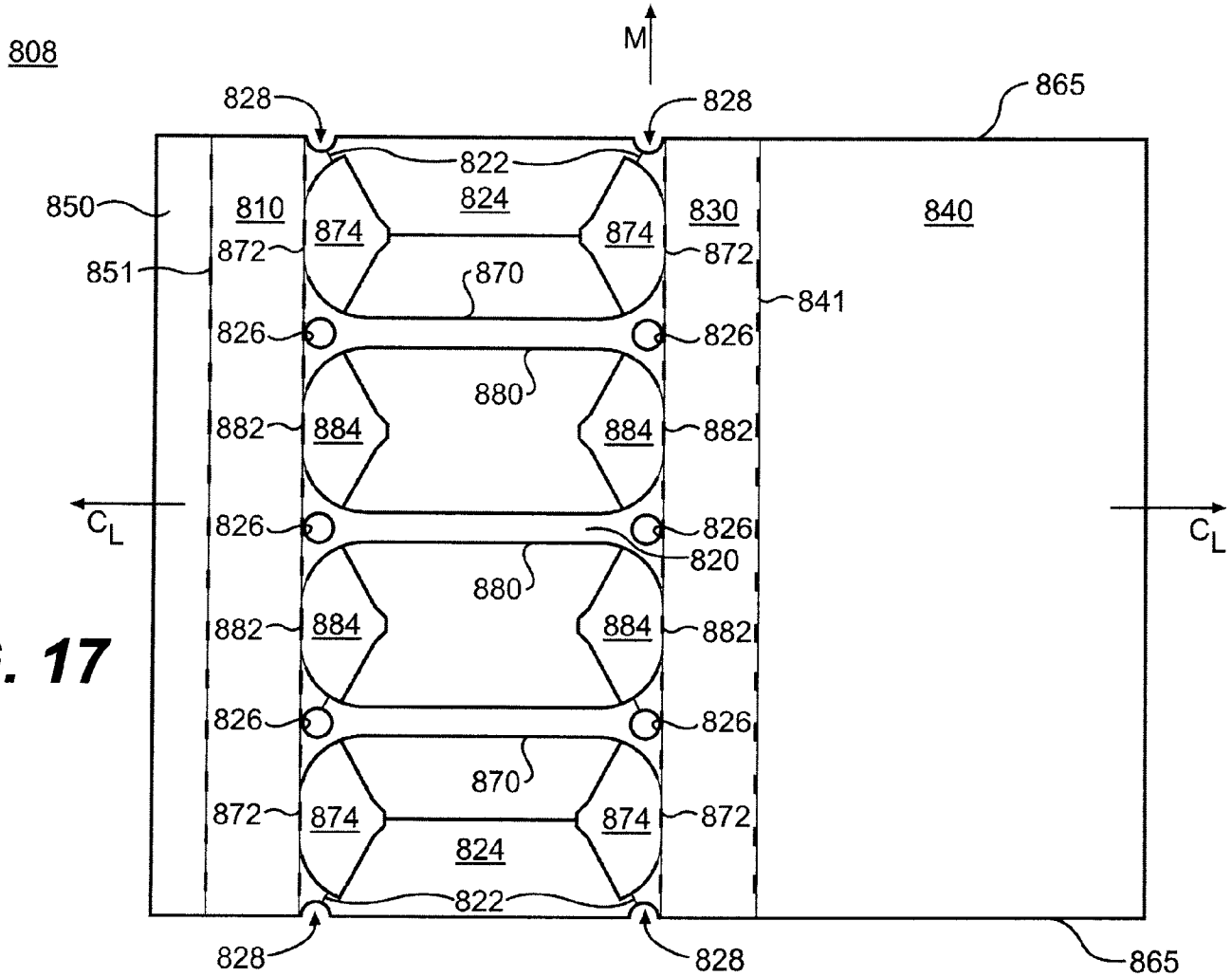
FIG. 17 is a plan view of a blank used to form a package according to a ninth embodiment of the disclosure.

FIG. 17 is a plan view of the exterior or printed side of a blank 808 used to form a carton according to a ninth embodiment of the disclosure. The carton accommodates eight containers C to form a package (not illustrated). The package accommodates the containers C in a 4×2×1 arrangement, including four rows and two columns of containers C, which are arranged in a single tier.

The blank 808 comprises a first side panel 810 foldably connected to a bottom panel 820 at a first transverse fold line 821, a second side panel 830 foldably connected to the bottom panel 820 at a second transverse fold line 831, a first top panel 840 foldably connected to the second side panel 830 at a third transverse fold line 841, and an adhesive panel 850 foldably connected to the first side panel 810 at a fourth transverse fold line 851.

The bottom panel 820 includes a pair of outer receiving apertures 870. Each outer receiving aperture 870 is shaped and sized to receive one or more containers C (not illustrated) that are to be accommodated within the carton. In the exemplary embodiment, each outer receiving aperture 870 is sized to receive two containers C. A pivot panel 824 is defined at each end of the blank 808. Each pivot panel 824 is defined in part by the cut used to form the adjacent receiving aperture 870, and by oblique lines of disruption 822 extending to the edges of the blank 808. Brace panels 874 connected at transverse fold or hinge lines 872 are defined at each side of each aperture 870. A pair of central receiving apertures 880 is defined between the outer receiving apertures 870. The central receiving apertures 880 are each sized to receive two containers C. Brace panels 884 connected at transverse fold or hinge lines 882 are defined at each side of the central receiving apertures 880. One or more locating apertures 826 may be formed in the interior of the blank 808, and one or more locating apertures 828 may be formed along one or more edges of the blank 808.

The blank 808 may be constructed into a package in a manner similar to the blank 708 (illustrated in FIG. 17), except that an additional row of containers C is introduced into the central receiving apertures 880.

Figure 18:
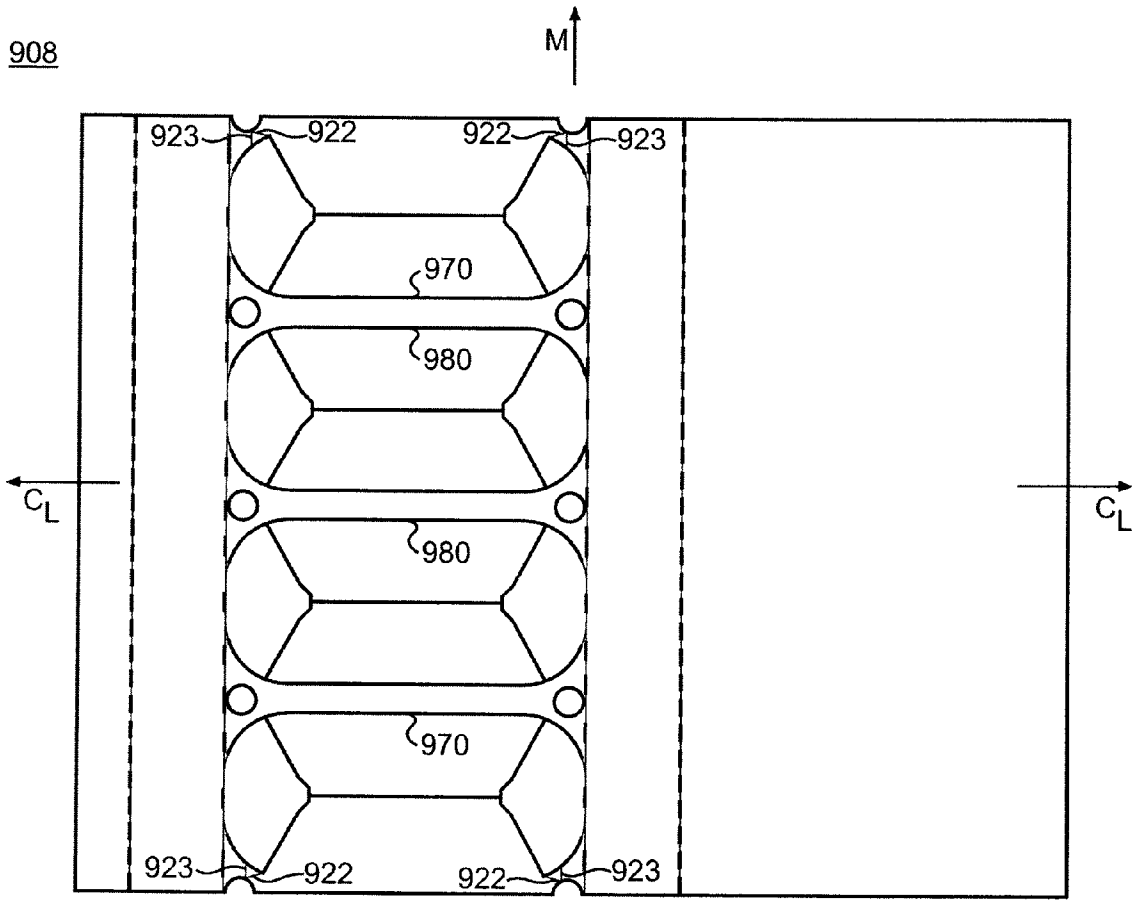
FIG. 18 is a plan view of a blank used to form a package according to a tenth embodiment of the disclosure.

FIG. 18 is a plan view of the exterior or printed side of a blank 908 used to form a carton according to a tenth embodiment of the present disclosure. The carton accommodates eight containers C to form a package (not illustrated). The package accommodates the containers C in a 4×2×1 arrangement, including four rows and two columns of containers C, which are arranged in a single tier. The blank 908 is substantially identical to the blank 808 illustrated in FIG. 17, except that the blank 808 includes a pair of crease lines 922, 923 at a distal corner of each receiving aperture 970.

Figure 19:
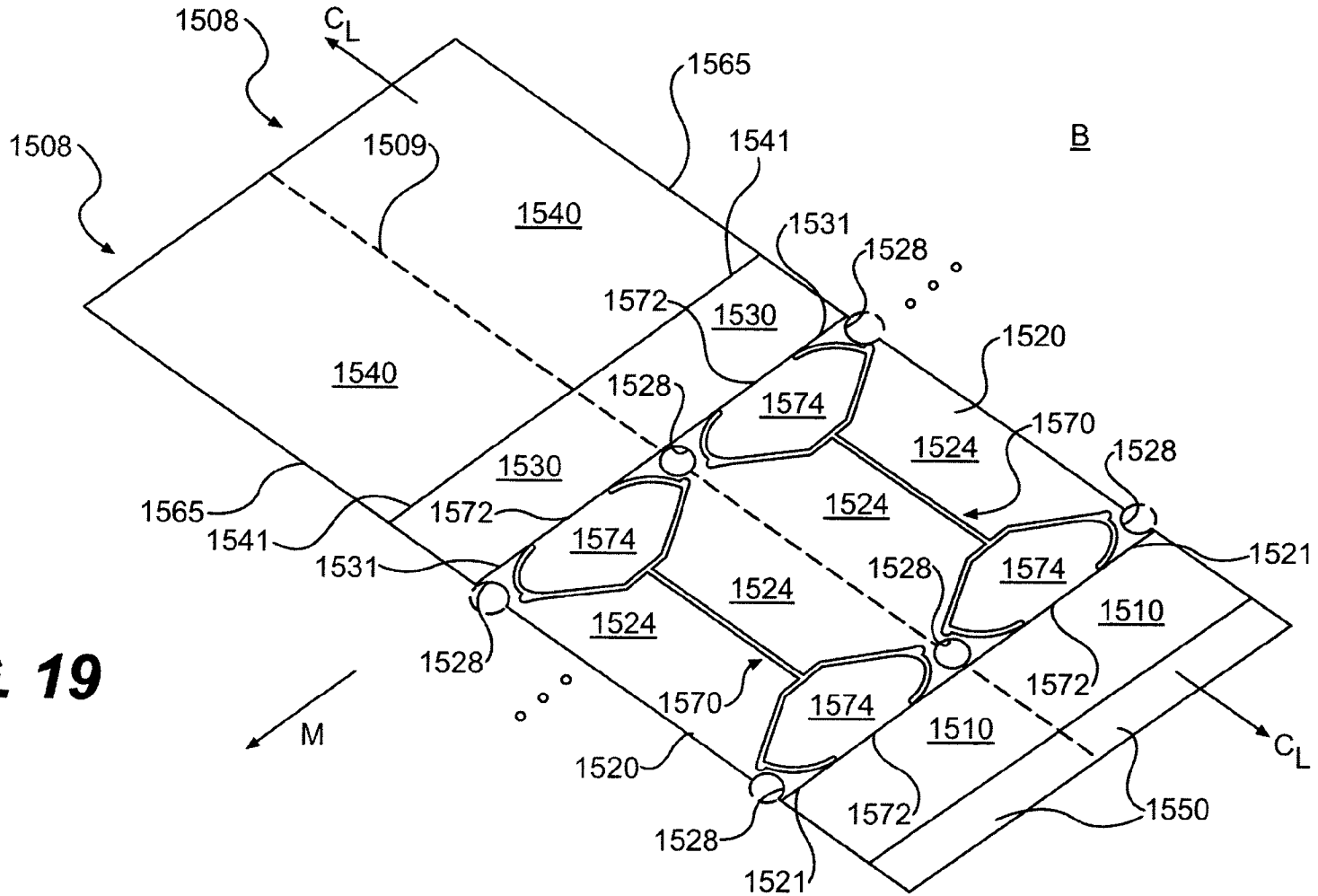
FIG. 19 is a plan view of a blank used to form a package according to an eleventh embodiment of the disclosure.

FIG. 19 is a plan view of the exterior or printed side of a blank B used to form a carton according to an eleventh embodiment of the present disclosure. The exemplary blank B is shown as two blank sections 1508 joined at a transversely extending line 1509. Each blank section 1508 comprises a first side panel 1510 foldably connected to a bottom panel 1520 at a first transverse fold line 1521, a second side panel 1530 foldably connected to the bottom panel 1520 at a second transverse fold line 1531, a first top panel 1540 foldably connected to the second side panel 1530 at a third transverse fold line 1541, and an adhesive panel 1550 foldably connected to the first side panel 1510 at a fourth transverse fold line 1551.

Figure 20:
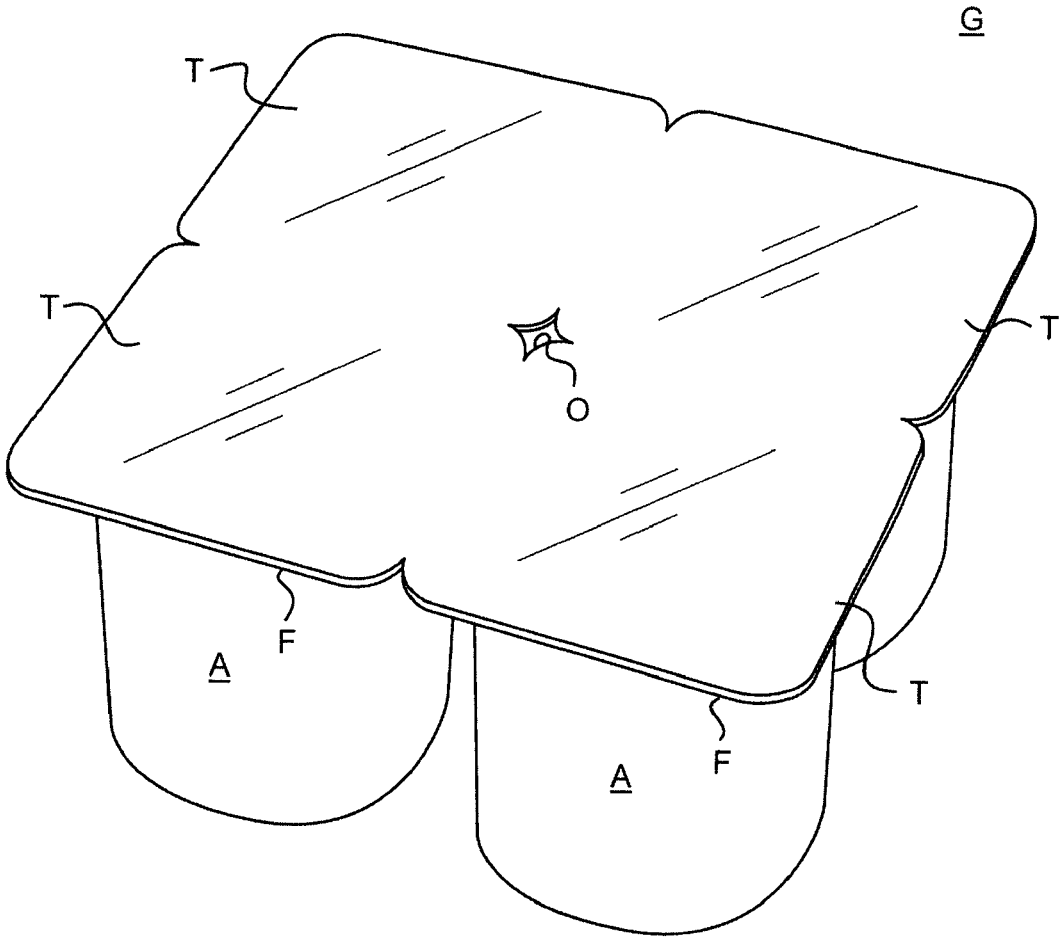
FIG. 20 illustrates a group of articles.

Each bottom panel 1520 includes a receiving aperture 1570. Each receiving aperture 1570 is shaped and sized to receive two articles A, which may be, for example, plastic tub containers C such as are shown in the previously illustrated embodiments. The dashed line 1509 represents a line along which the blank sections 1508 can be separated from one another, if desired. FIG. 20 illustrates an exemplary 2×2×1 group G of four articles A that can be accommodated in a package formed from the blank B. Each article A has a flange F and the top of each article A can be covered by a foil top covering T. The group G can have an opening O in the top T.

Referring back to FIG. 19, a pivot panel 1524 is defined at each end of each section 1508 of the blank B. Each pivot panel 1524 is defined in part by the cut used to form the receiving aperture 1570. Brace panels 1574 connected at transverse fold or hinge lines 1572 are defined at each side of each receiving aperture 1570. One or more locating apertures 1528 may be formed along the separation lines 1509 between adjacent blank sections 1508 and along the end edges 1565 of each blank section 1508. During packaging operations, the blank sections 1508 may each be one of a series of similar blanks aligned end-to-end and moving through the packaging machine. The blank sections 1508 may be adjacent to one another and/or breachably joined in a continuous series along end edges 1565. The series of blank sections 1508 move through a packaging machine in the machine direction indicated by the arrow M. Packaging of articles in blanks B is discussed in detail below with reference to FIGS. 21-35.

FIGS. 21-36 schematically illustrate a continuous motion packaging system 1100 according to the principles of the present disclosure. The packaging system 1100 is suitable for continuously wrapping a series of the blanks B (FIG. 19) around the article groups G (FIG. 20) to form packages P, which are illustrated exiting the system 1100 at the right hand side of FIG. 21. The system 1100 is described below as packaging the 2×2×1 article groups G in the blanks B, although the system 1100 is generally suitable for use with any of the blanks discussed in this specification. Also, other article group arrangements, such as, for example, 1×2×1, 3×3×1, etc. can be packaged in accordance with the principles of the present disclosure.

Figure 21:
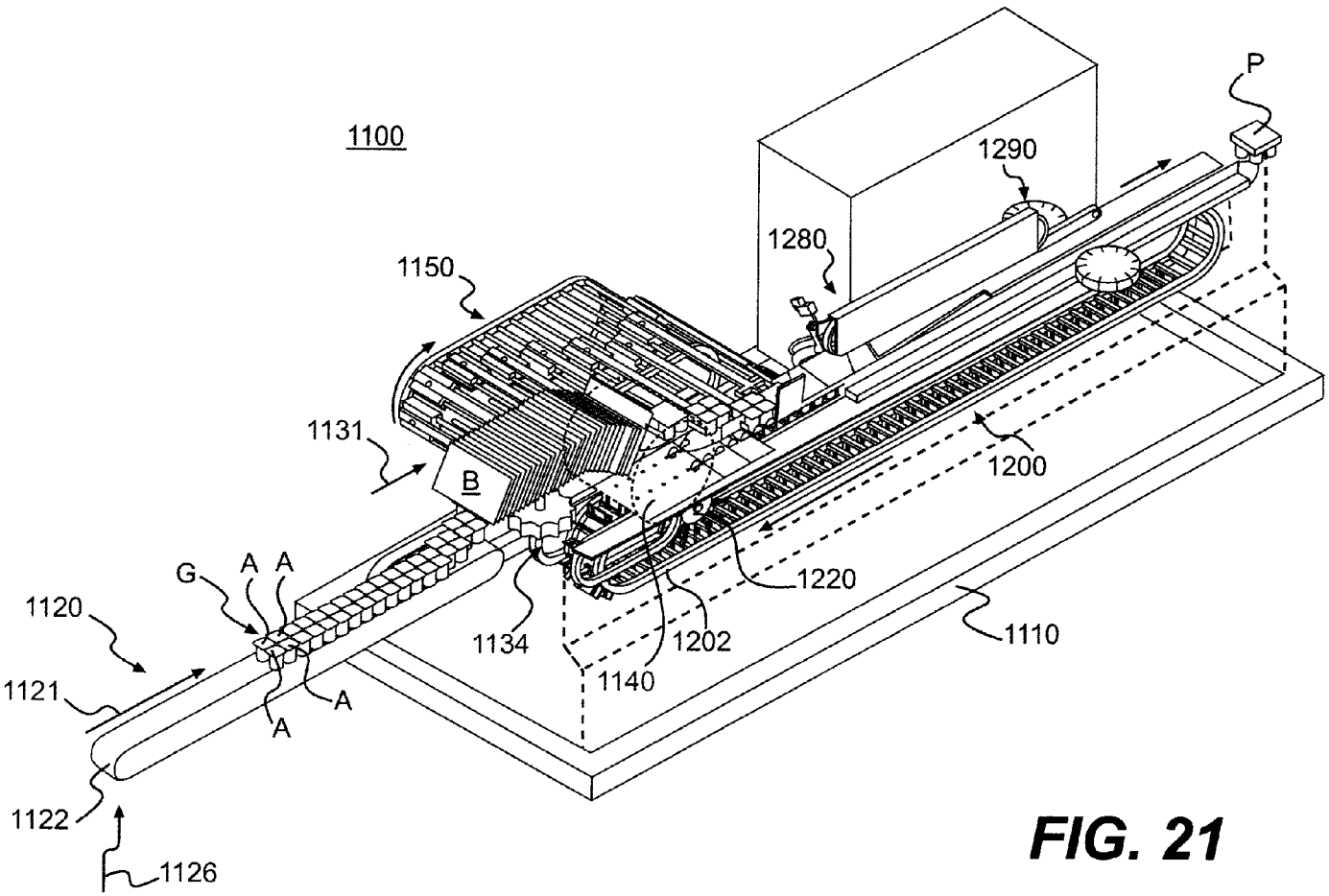
FIG. 21 illustrates a packaging system according to the present disclosure.
Figure 22:
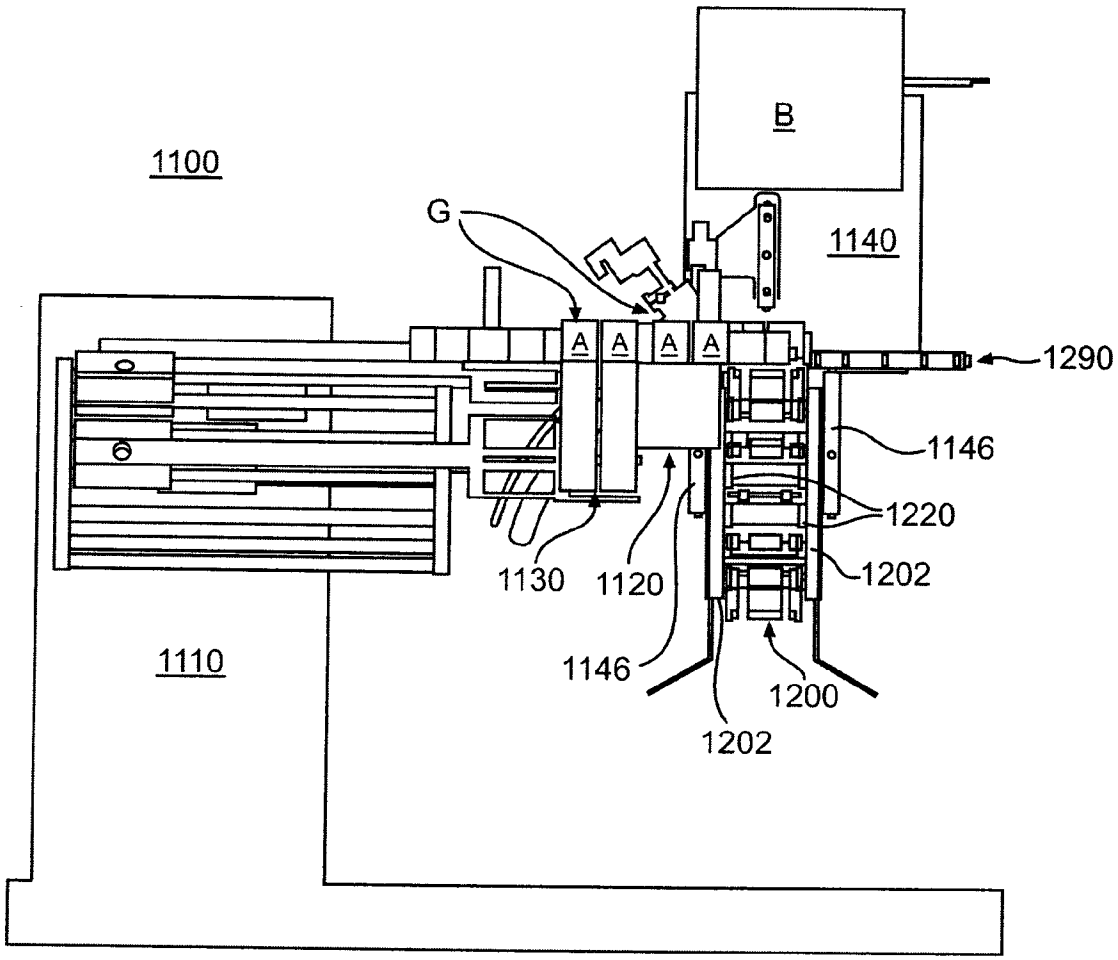
FIG. 22 is a side elevation of the packaging system when viewed from an infeed end of the system.
Figure 23:
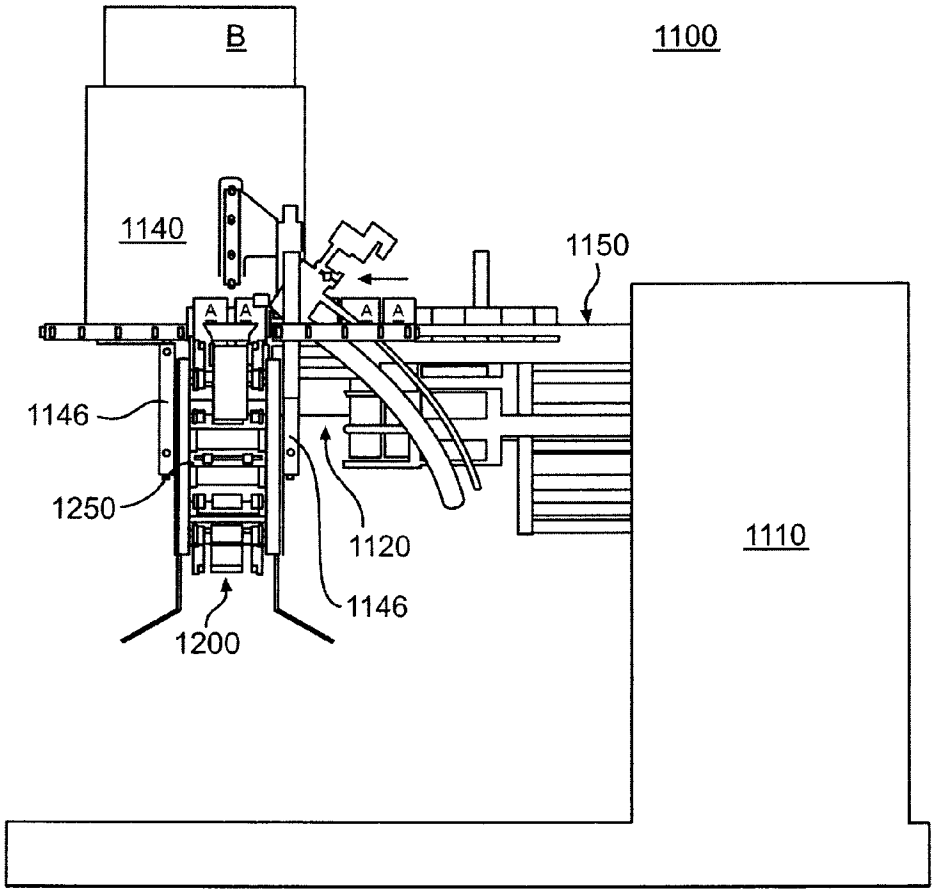
FIG. 23 is a side elevation of the packaging system when viewed from an exiting end of the system.
Figure 24:
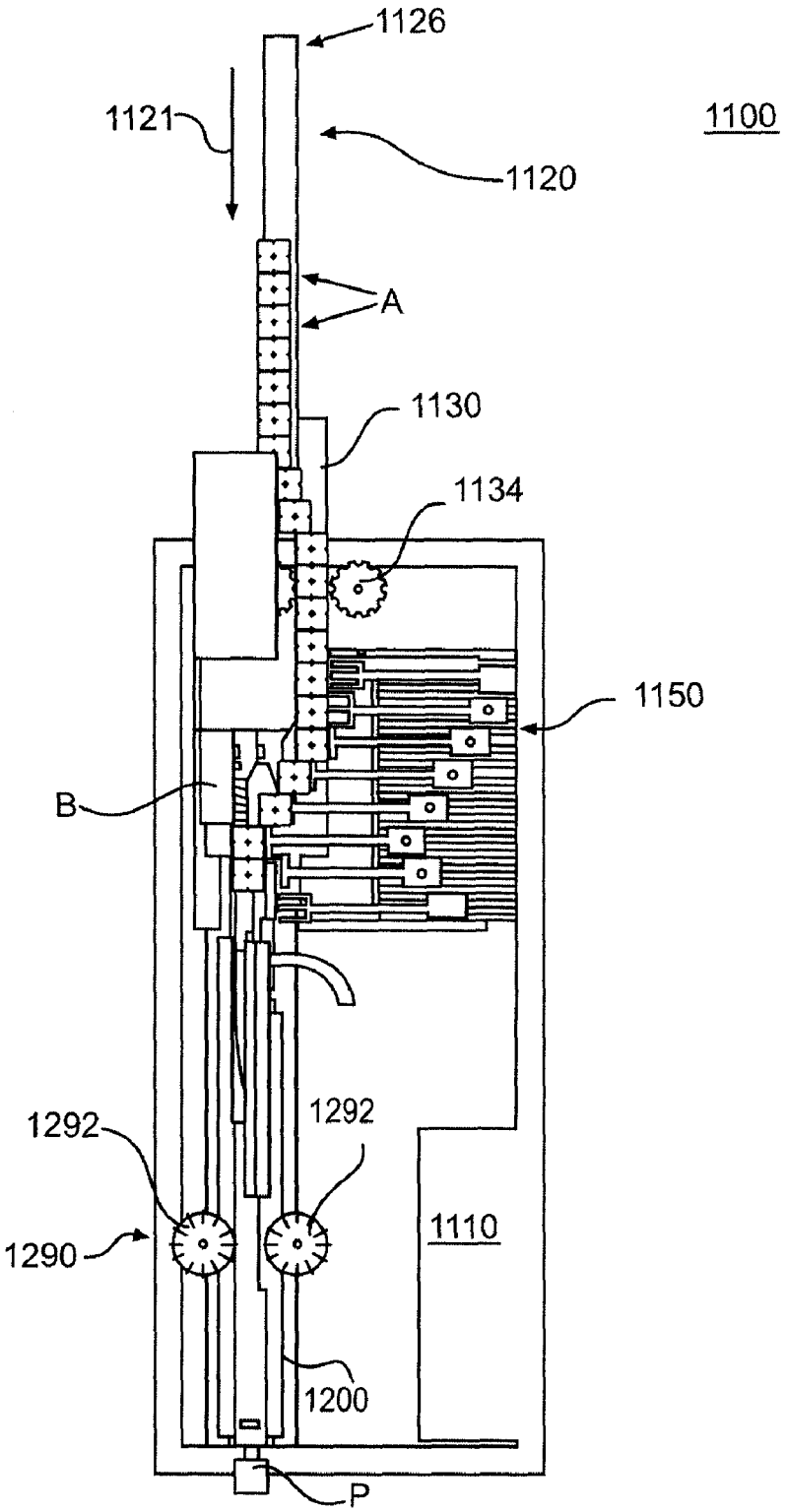
FIG. 24 is an overhead view of the packaging system.

Referring to FIGS. 21-24, the packaging system 1100 is illustrated as mounted on a base 1110 which is shown partially in outline. In general, the packaging system 1100 includes an article infeed conveyor 1120, a packaging conveyor 1130, a blank feeder 1140, a cross-transfer device 1150, a main flight 1200, a registration device 1280, and a separation device 1290. The blank feeder 1140 may be of conventional design and is illustrated schematically in some figures and omitted in other figures in order to better illustrate other portions of the system 1100. In FIG. 21, the blank feeder 1140 is shown in outline form so that other sections of the system 1100 are visible.

Referring to FIG. 21, the article infeed conveyor 1120 moves a series of articles A along an article infeed path along a direction indicated by arrows 1121. The articles A may be, for example, joined at their tops into predetermined groups G of various configurations. The articles A can, for example, generally be joined in groups of a number corresponding to the number of articles to be accommodated in each tier of the packages P. Smaller groups G can also be used such that multiple groups G are used to form a single package. The groups G enter the packaging system 1100 at an upstream end 1126 and are conveyed along a belt 1122 of the article infeed conveyor 1120.

Figure 25:
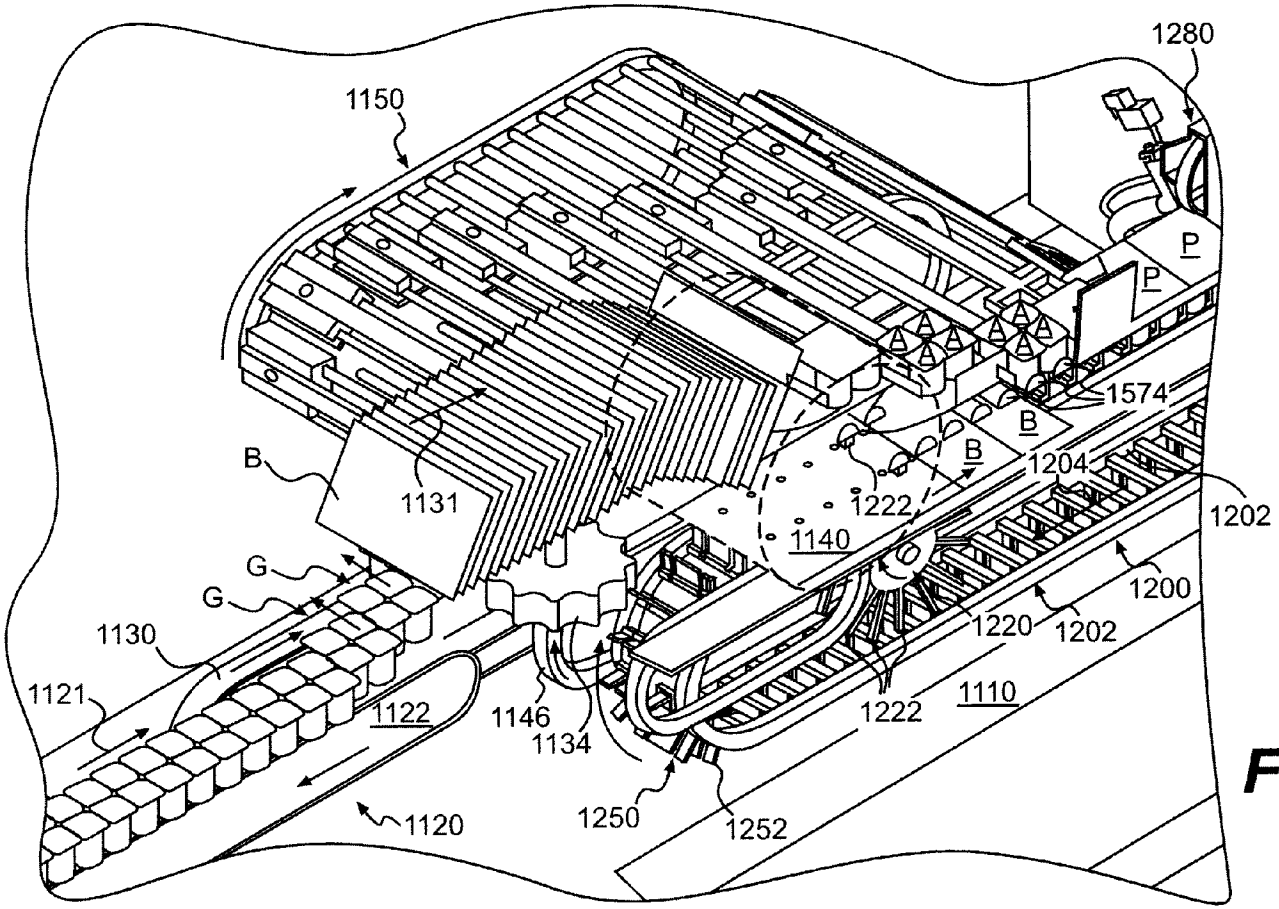
FIG. 25 is a detailed view of blank loading and closing in the packaging system.
Figure 26:
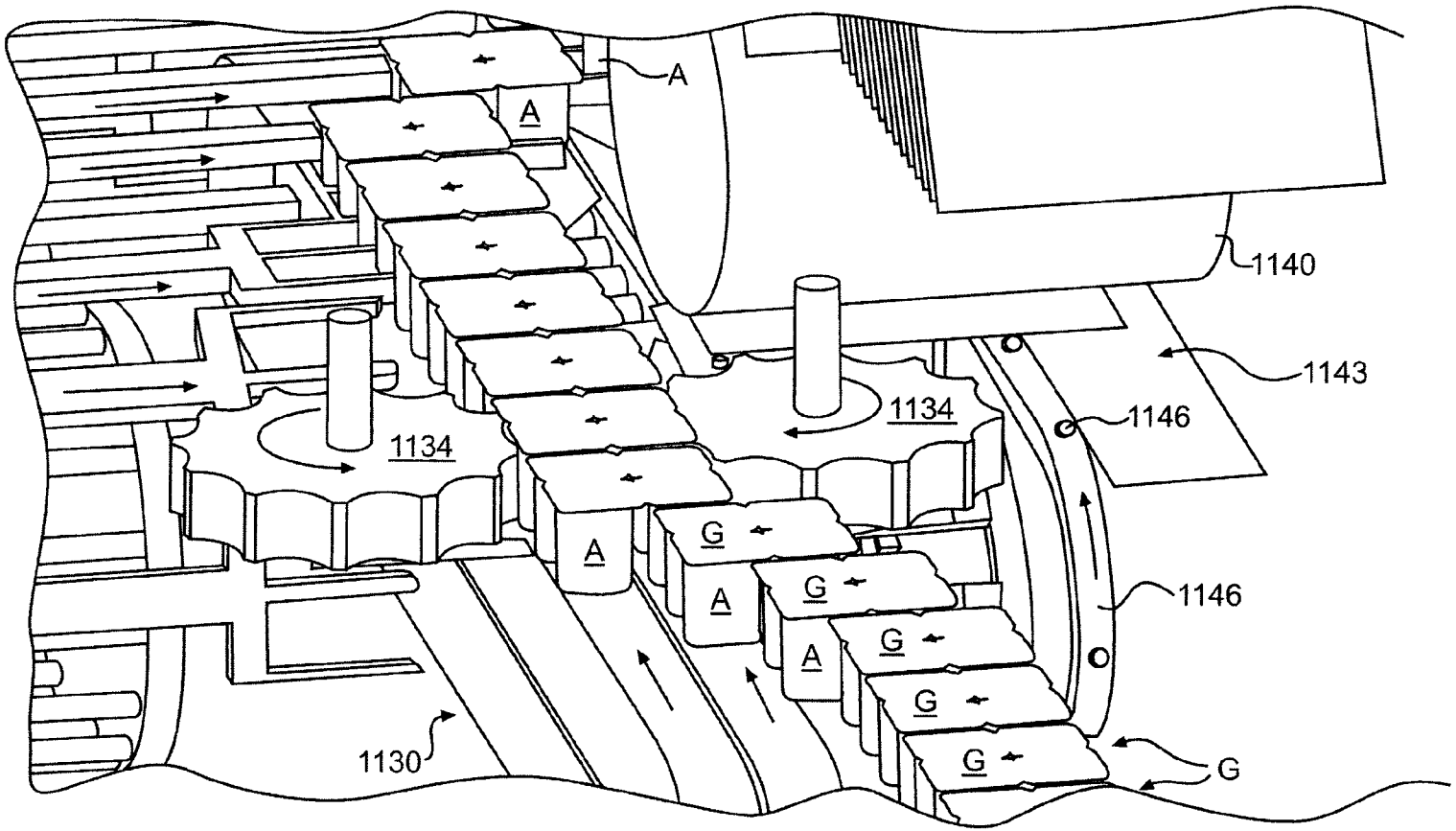
FIG. 26 is a detailed view of articles advanced toward a loading position in the packaging system.

Referring to FIGS. 25 and 26, the groups G are shifted from the infeed conveyor 1120 to the packaging conveyor 1130, where they are metered through a pair of rotating starwheels 1134. The packaging conveyor 1130 conveys the metered article groups G to positions where they are engaged by the cross-transfer device 1150, which in turns moves each group toward a loading position, as discussed in further detail below. The article groups G are moved along the packaging conveyor 1130 at a speed along the machine direction matching the speed of the blanks B. The blank feeder 1140 picks up and places the blanks B into a paperfeed 1143. For illustrative purposes, the blank feeder 1140 is shown schematically as a partially see-through cylindrical element in FIG. 25. The blank feeder 1140 may be, for example, a conventional three arm rotary feeder. The carton blanks B are provided to the blank feeder 1140 in the direction of the arrow 1131.

Figure 27:
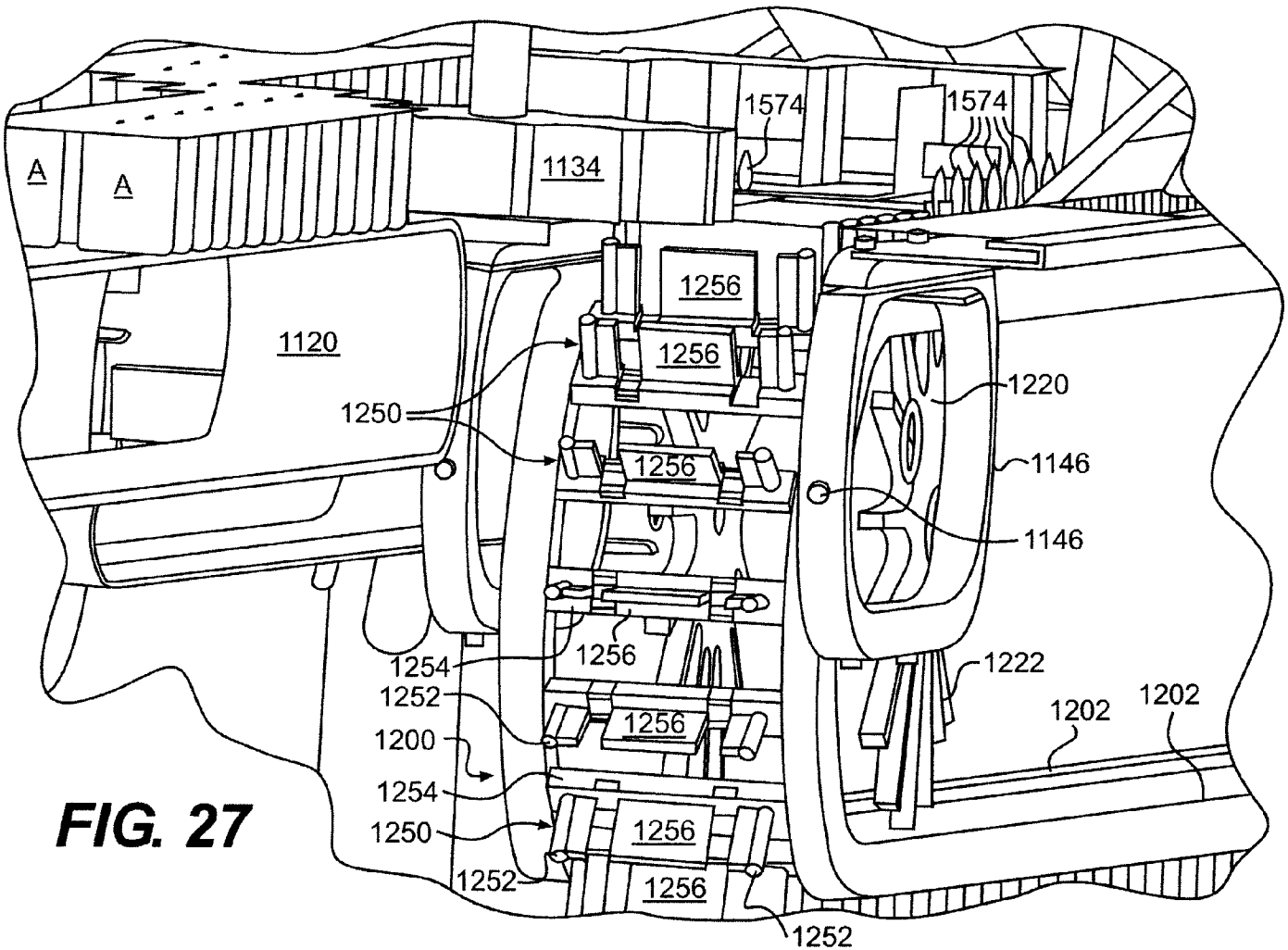
FIG. 27 is a detailed view of a main flight of the packaging system.

Referring to FIG. 27 and also to FIG. 25, the main flight 1200 comprises a pair of chains 1202 continuously rotating in a direction indicated by the arrow 1204 and a series of spaced flights 1250 mounted on the chains. The chains 1202 move the main flights 1250 in a continuous loop. Each flight 1250 includes a pair of main flight pins 1252 for engaging locating apertures in the blanks B, a base 1254, and a central plate 1256 for supporting the blanks. The blanks B can be positioned by the feeder 1140 directly onto main flight pins 1252 of the flights, or, alternatively paperfeed pusher lugs 1146 can time the blanks B onto the main flight system 1200. Each blank B is transported on the flights 1250 by the main flight pins 1252 engaging the locating apertures in the blanks B. A pair of continuously rotating punch-up wheels 1220 rotate beneath the blanks B as they are conveyed along the main flight system 1200. As will be discussed in further detail below, the punch-up wheels 1220 include a plurality of spokes 1222. The spokes 1222 push up the brace panels 1574 on the blanks B prior to the groups G being dropped into receiving apertures 1570 in the blanks B.

Figure 28:
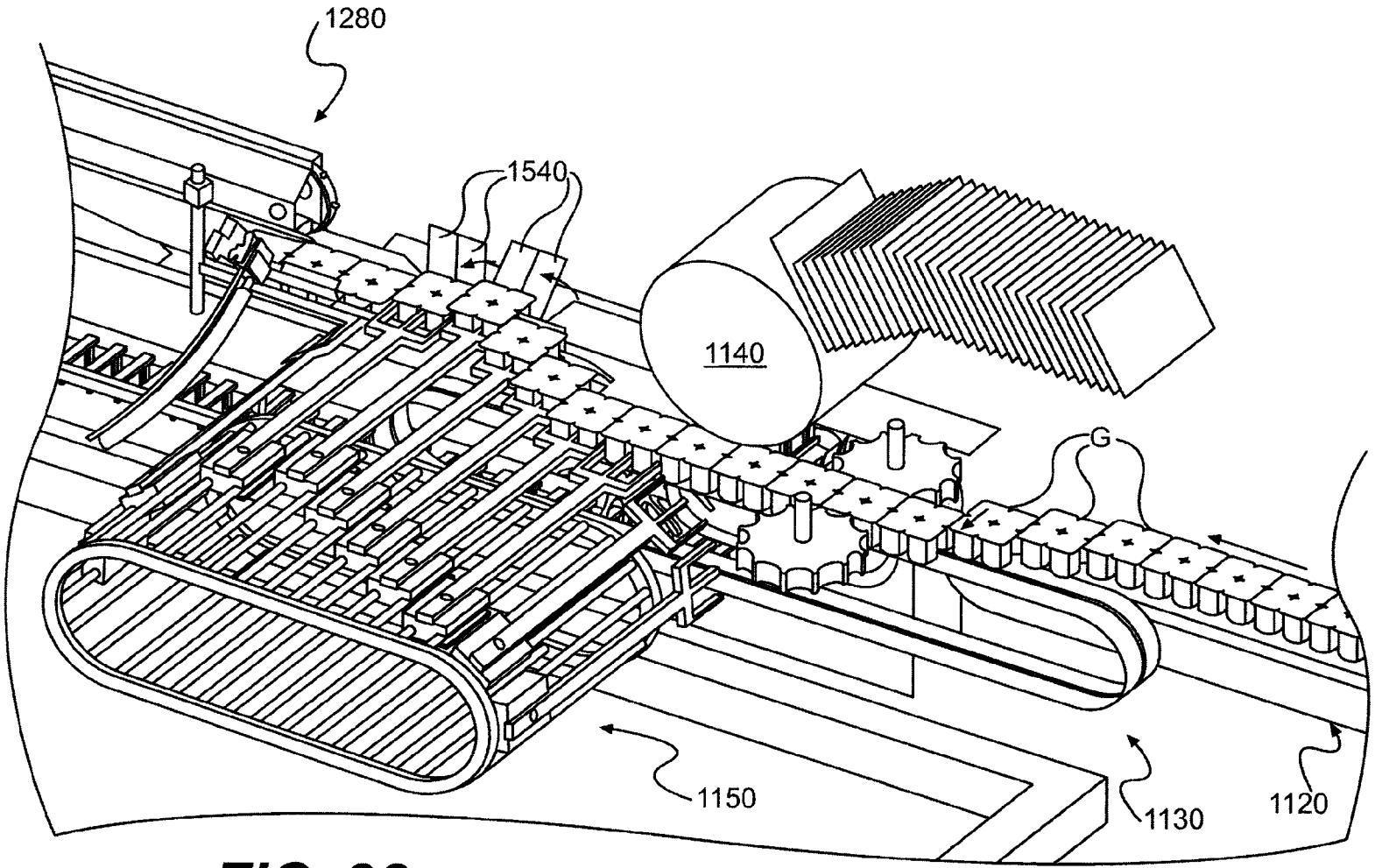
FIG. 28 is a detailed view of blank loading and closing in the packaging system.

Referring generally to FIG. 28, the cross transfer device 1150 engages the article groups G and individually transfers each group G laterally so that it overlies an associated package blank B. The cross transfer device 1150 can be, for example, a lateral barrel cam assembly, or other conventional cross transfer device as known in the art. Loading of the article groups G into respective blanks B is discussed below with reference to FIGS. 29-33. The blank feeder 1140 is omitted in FIGS. 29-32 to better illustrate loading of the blanks B.

Figure 29:
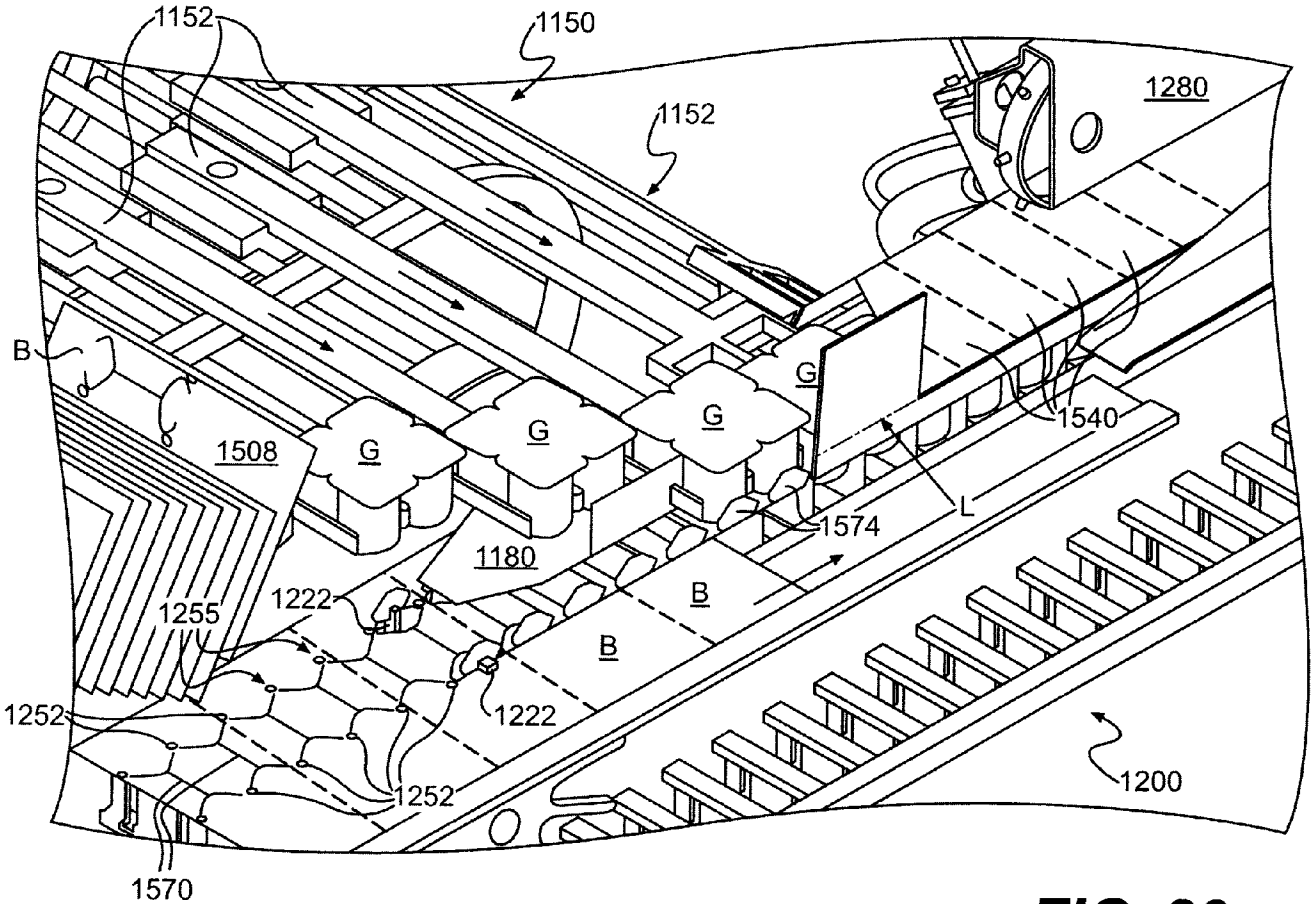
FIG. 29 is a detailed view of a cross-transfer device of the packaging system.
Figure 30:
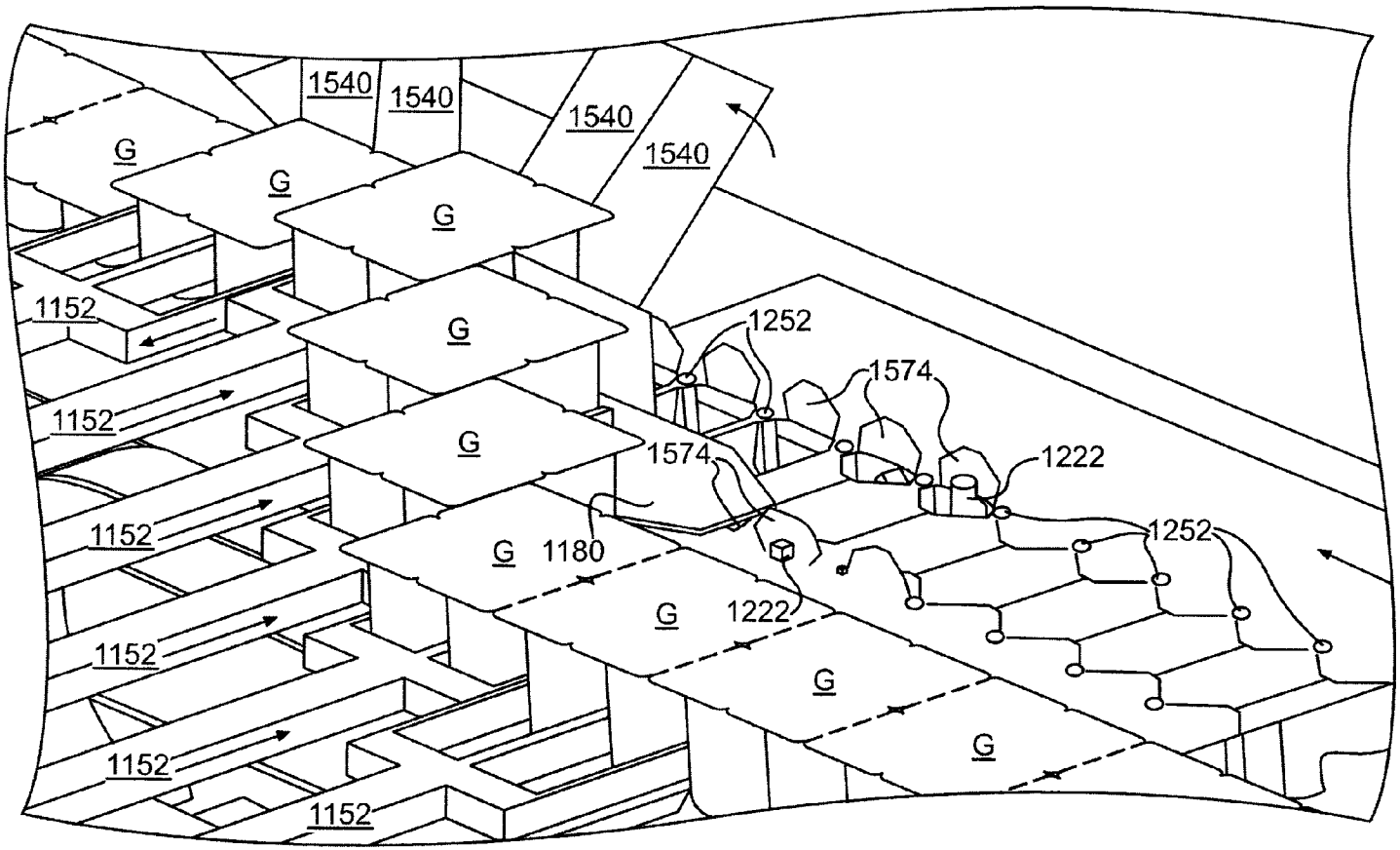
FIG. 30 illustrates the cross-transfer device moving articles into the loading position.

Referring to FIGS. 29 and 30, as the push-up wheels 1220 rotate, the spokes 1222 of the wheels 1220 push up the brace panels 1574 of the blanks B so that the brace panels 1574 extend generally upright. Brace panels 1574 on the article group side are plowed over flat by a plow 1180 to allow the group G bases to pass over. The continuous series of blanks B is conveyed along the pins 1252 of the main flights 1250, which extend though the locating apertures 1528 in the blanks B. The undersides of the center portions of the blanks B are supported by the plates 1256 of the flights 1250 (shown in FIG. 27).

Figure 31:
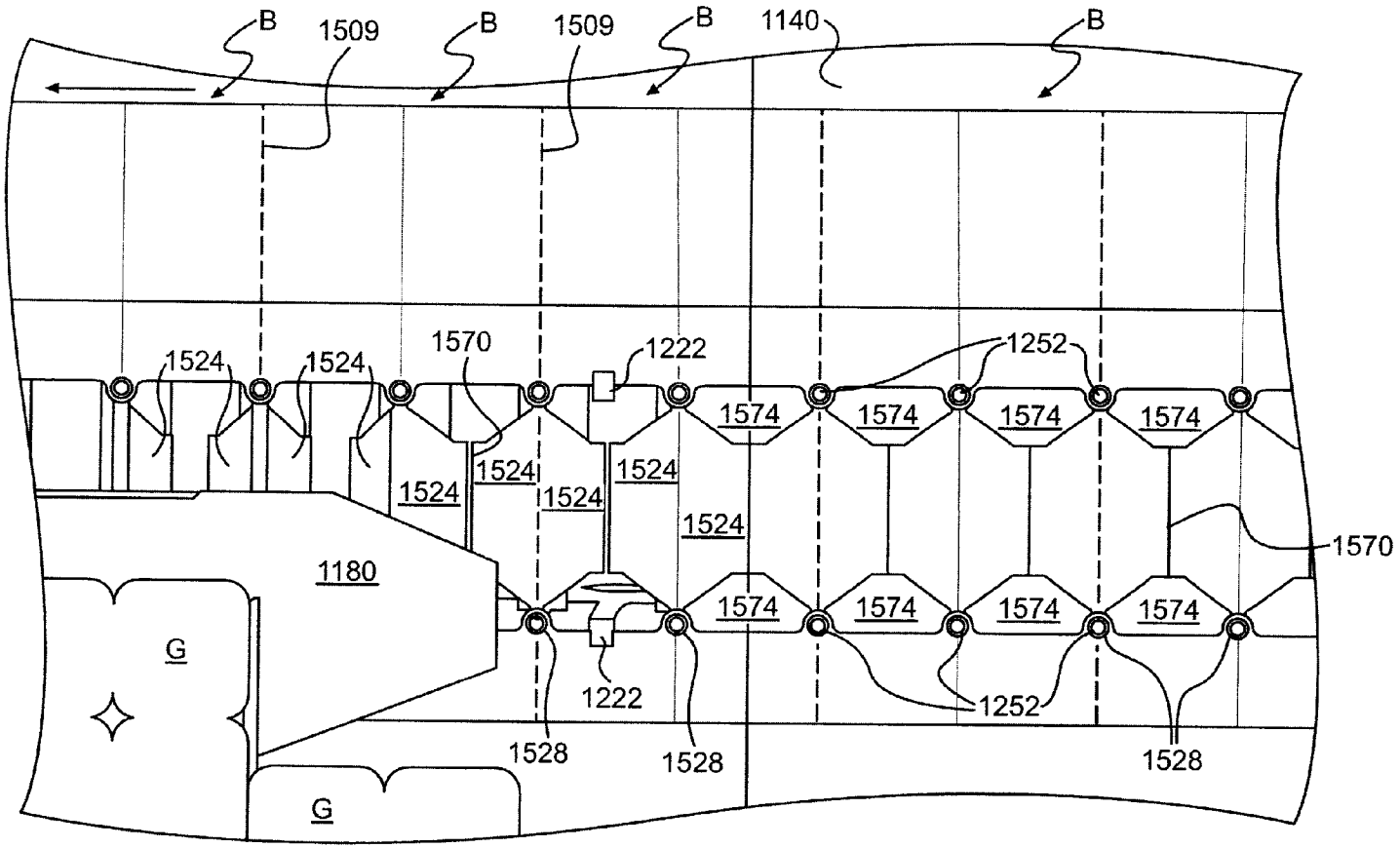
FIGS. 31-33 are overhead views illustrating loading and closing of blanks in the packaging system.

Referring to FIGS. 29 and 30 and also to FIG. 31, as the series of blanks B translates through the cross-transfer device 1150, fork arms 1152 of the cross-transfer device 1150 laterally (e.g., transverse to the machine direction) sequentially and continuously transfer the groups G into the position L where the groups are loaded or dropped into the blanks B. As each article group G is released by a fork arm 1152 at the article group loading position L, the bases of the 2×2 group of articles A pass through a pair of adjacent receiving apertures 1570 and push the pivot panels 1524 downward. The pivot panels 1524 can be, for example, prebroken by an overhead spoked wheel, for example (not illustrated).

Referring to FIG. 31, the blanks B, as well as any of the blanks disclosed in this specification, may be provided as a continuous, connected series of blanks with the blanks connected to one another by breachable lines of disruption at their end edges. In FIG. 31, the solid lines connecting adjacent blanks B may be breachable lines of disruption such as a score line, a cut line, a cut-crease line, a cut-score line, combinations thereof, and other forms of disruption that allow the blanks to be separated at the separation device 1290 shown in FIG. 34. Advancing a continuous series of connected blanks through the packaging system 1100 increases the rate at which blanks that can be loaded and erected by the system.

Figure 32:
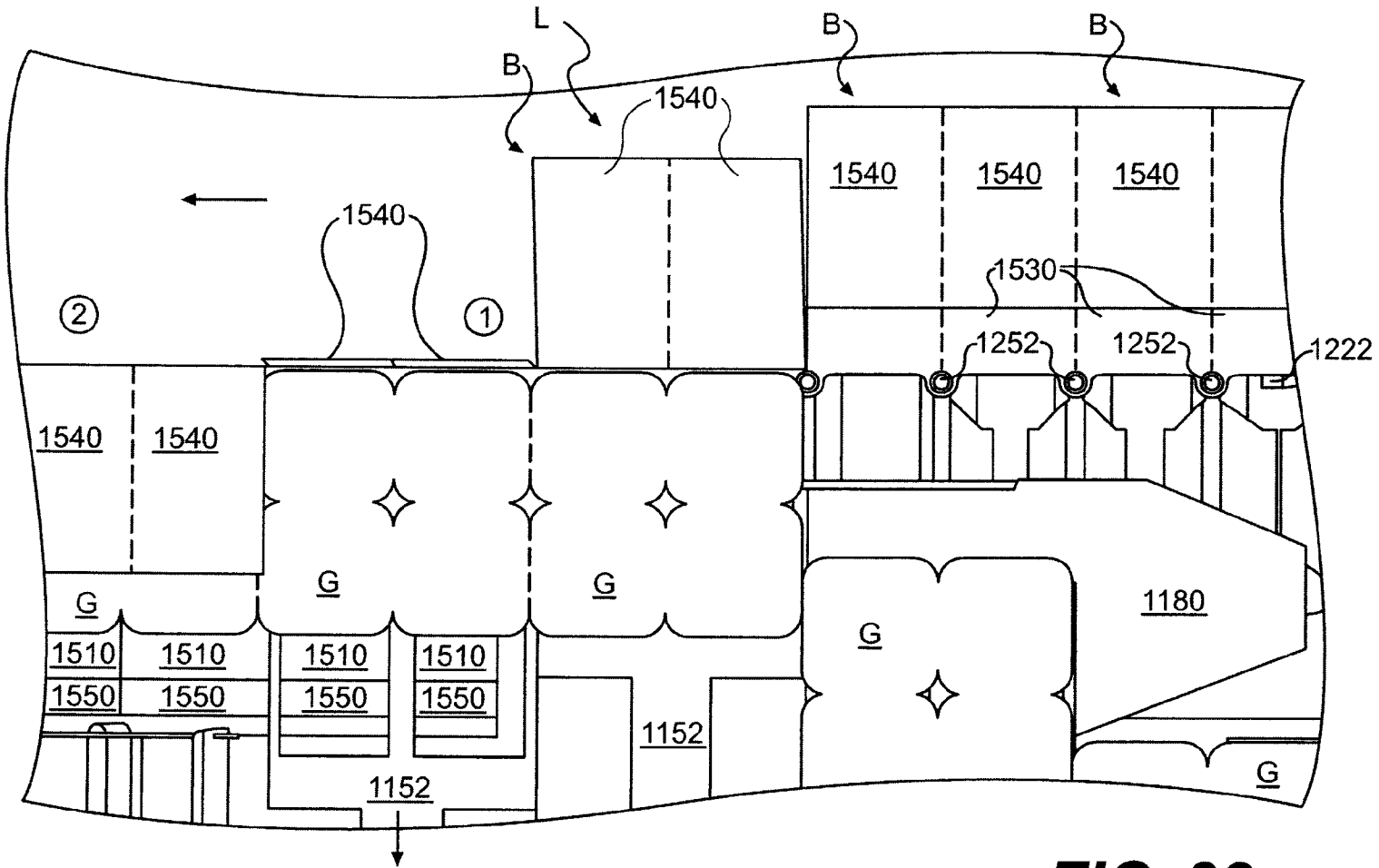
Figure 33:
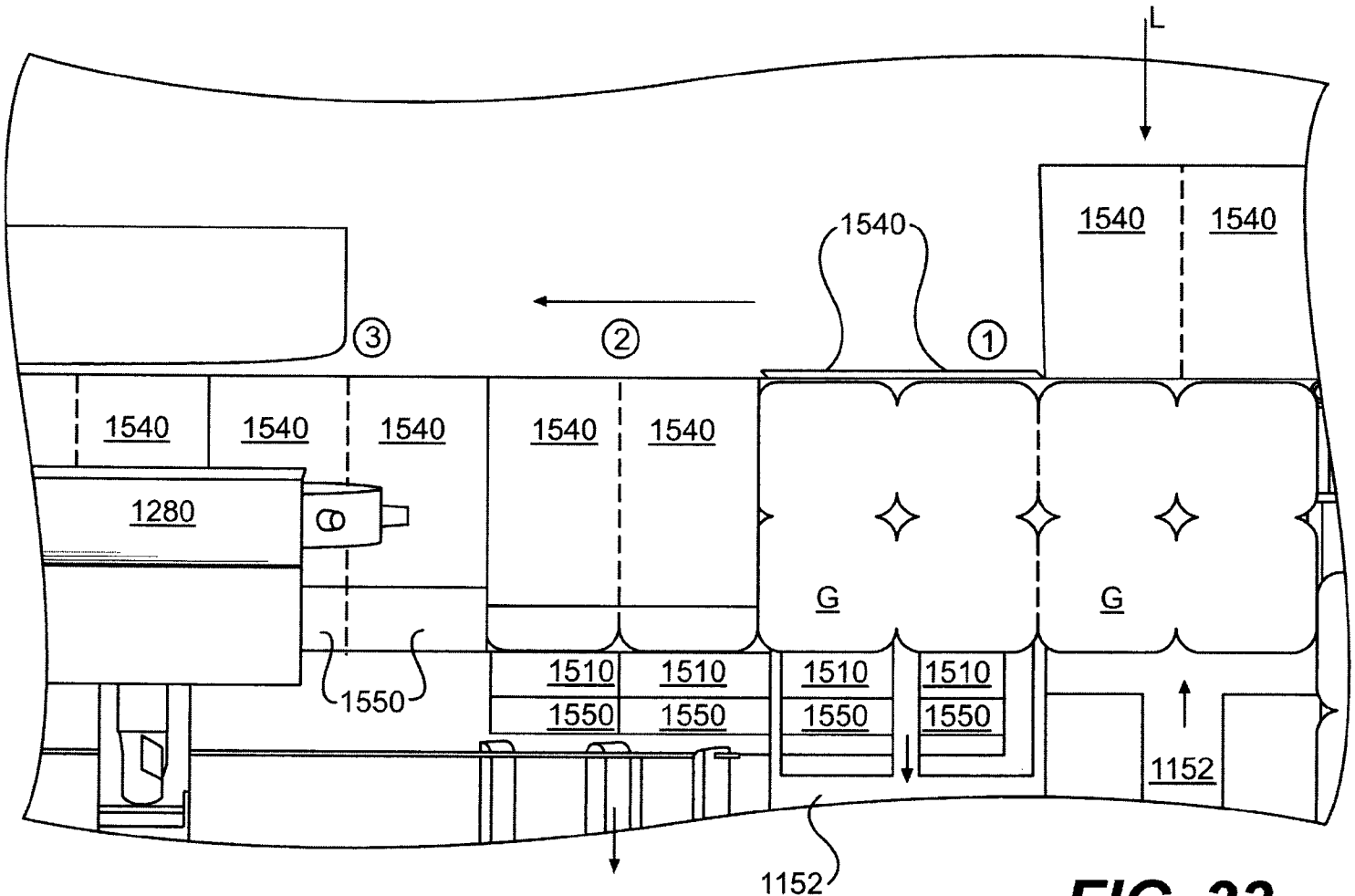

Referring to FIG. 32, after a group G is dropped into a pair receiving apertures 1570 at the loading position L, the side panels 1530 and the top panels 1540 are folded generally upwardly at position 1, and the top panels 1540 are folded over the tops of the article groups G at position 2. Referring to FIG. 33, the side panels 1510, 1530 and the top panels 1540 are folded generally upwardly at position 3. The adhesive panels 1550 are then folded over and adhered to the top panels 1540. A registration device 1280 can sequentially breach a brace feature (not shown) in the top panels 1540, if present (an example of such a feature is exemplified by the brace 142 shown in FIG. 3).

Figure 34:
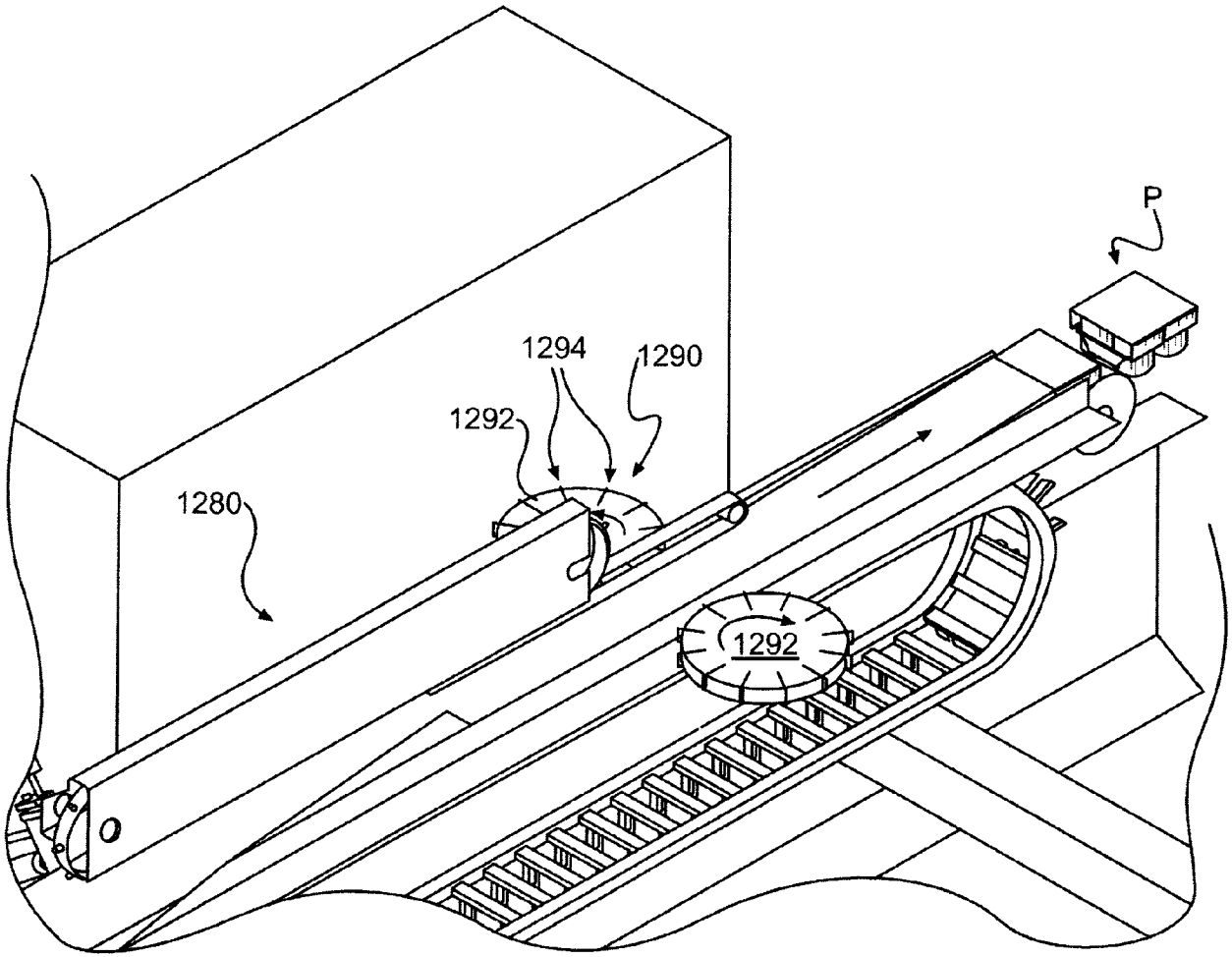
FIG. 34 illustrates a separation device of the packaging system.
Figure 35:
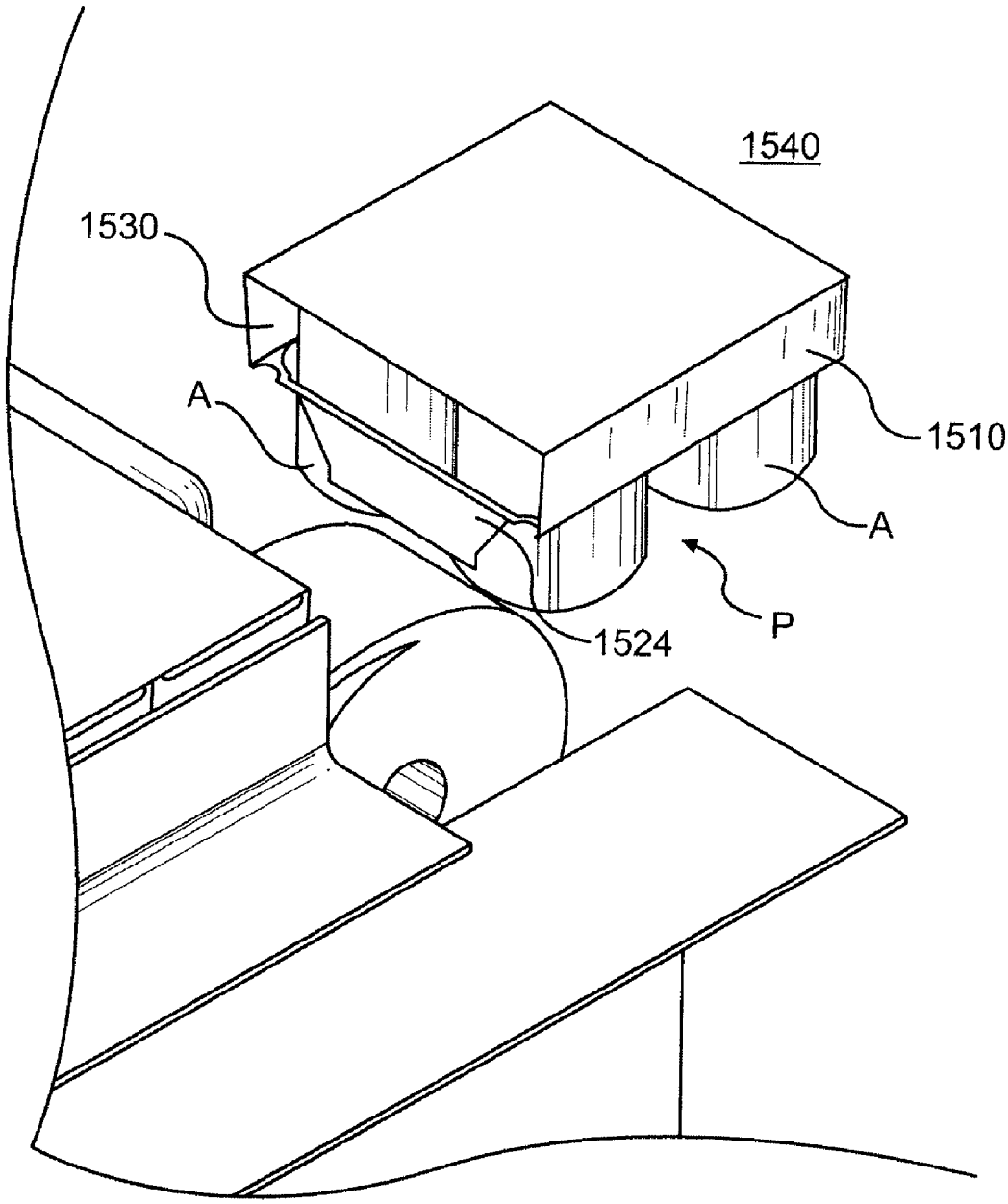
FIG. 35 illustrates a completed package exiting the exit end of the packaging system.

Referring to FIG. 34, when the article groups G are loaded into the blanks B and the blanks are closed around the articles to form packages P, the packages P are conveyed away by the main flight system 1200. Adjacent packages P may still be joined at the end edges of their blanks B by breachable lines of disruption. The separation device 1290 includes rotating sidewheels 1292 with blades 1294 extending radially outward therefrom. The blades 1294 separate the packages P at the breachable lines of disruption between the packages P. Referring to FIG. 34, the packages P are illustrated as including four tub articles A. FIG. 35 illustrates a package P exiting the packaging system 1100. Packages exiting the system 1100 may be conveyed away on a conveyor or other means.

Referring again to FIG. 20, the article group G includes a central opening O in the top T. In blanks in which the package top is closed by engaging a locking projection with a locking aperture, such as the blank shown in FIG. 5, the locking aperture can be pressed through the opening O in an enclosed group to further secure the group within the package. Also, if a brace is included in the top panel, such as the brace 142 shown in FIG. 3, the registration device 1280 can press the brace flaps into the opening O to further secure the group within the package. In general, any of the packages discussed in this specification can include a brace as shown in FIG. 3.

According to the present disclosure, a wide variety of package configurations can be formed from single or multiple blank sections with little adjustment to the packaging system 1100. For example, a 1×2×1 package could be formed using the apparatus illustrated in FIGS. 21-35 by providing 1×2 article groups G. In this case, the separation device 1290 would breach the blank B at every separation line 1509 (see FIG. 19) between adjacent blank sections 1508. For a 3×2×1 configuration, a series of blanks B similar in configuration to the blanks B in the illustrated embodiment could be used. The cross-transfer device 1150 could be modified to load three rows of articles A simultaneously into three adjacent and joined blank sections 1509. A 2×4×1 package configuration could similarly be achieved by providing groups G comprising eight articles A, and separating the blank sections at every fourth row of articles. The article groups G can, for example, be provided as any combination of adjacent articles A. For example, a 4×2×1 package could be formed using article groups G in a 2×2×1 configuration (as shown in FIG. 20), and loading two adjacent groups G into each blank. Similarly, a 2×2×1 package could be formed by loading two adjacent 1×2 groups G. The packaging system 1100 is therefore product pitched and accommodates a wide variety of article packaging functionalities.

The packaging system 1100 described above is addressed to a package embodiment having a single tier of articles. A packaging machine for packaging multiple or two-tiered packages in accordance with the principles of the present disclosure could introduce a second tier of articles at the infeed end 1126 of the system. The series of article groups G for the second tier may be metered by a pair of starwheels oriented above the starwheels 1134. The cross transfer device 1150 could include a separate upper tier of fork arms for engaging the second tier article groups G. Alternatively, the fork arms of the device 1150 could be modified to engage multiple tiers of article groups G.

In the above embodiments, the articles are shown as generally tub-like containers C having a generally rectangular upper rim or flange. Other types of container and article groups, however, can be accommodated within cartons according to the principles of the present disclosure.

In the exemplary embodiments discussed above, the exemplary blanks may be formed from, for example, paperboard, clay coated newsprint (CCN), solid unbleached sulfate board (SUS), and other materials. The blanks can also be constructed of other materials, such as cardboard, or any other material having properties suitable for enabling the carton to function at least generally as described above.

The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

For purposes of the description presented herein, the term "line of disruption" can be used to generally refer to cuts, scores, creases, cut-space lines, cut-creases, cut-scores, combinations thereof, and other forms of disruption formed in the material of the blanks. A "breachable" line of disruption is a line of disruption that is intended to be breached during ordinary use or packaging of the blanks. Examples of breachable lines of disruption include cut-creases, cut-scores, cut-spaces, scores, combinations thereof, etc.

In accordance with the above-described embodiments of the present disclosure, a "fold line" can be any substantially linear, although not necessarily straight, line of disruption or other form of weakening that facilitates folding therealong. The term "line" as used herein includes not only straight lines, but also other types of lines such as curved, curvilinear or angularly displaced lines.

In the present specification, a "panel" or "flap" need not be flat or otherwise planar. A "panel" or "flap" can, for example, comprise a plurality of interconnected generally flat or planar sections. The above embodiments may be described as having one or panels adhered together by glue. The term "glue" is intended to encompass all manner of adhesives commonly used to secure paperboard carton panels in place.

The foregoing description of the disclosure illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A series of interconnected blanks, comprising:

each blank of the series of interconnected blanks having two longitudinal end edges and two lateral end edges extending generally between the longitudinal end edges;

two adjacent blanks of the series of interconnected blanks being connected to one another at adjacent longitudinal end edges by a breachable line of disruption; and each blank of the series of interconnected blanks comprising a first side panel, at least one top panel, a second side panel, a bottom panel foldably connected to the first side panel at a first fold line and foldably connected to the second side panel at a second fold line, wherein the bottom panel includes corners that are each at least partially defined by both a respective one of the longitudinal end edges and a respective one of the first and second fold lines, at least one receiving aperture in the bottom panel, and a plurality of locating apertures formed in a respective one of the two longitudinal end edges, each of the plurality of locating apertures is located at a respective one of the corners of the bottom panel and is adjacent at least one of the first fold line and the second fold line, wherein for each blank of the series of interconnected blanks, each locating aperture of the plurality of locating apertures extends into the bottom panel from at least one straight portion of the respective one of the two longitudinal end edges, wherein for a first blank of the two adjacent blanks, at least one of the plurality of locating apertures of the first blank cooperates with a respective locating aperture of a second blank of the two adjacent blanks to form a compound aperture, so that the compound aperture includes both the at least one of the plurality of locating apertures of the first blank and the respective locating aperture of the second blank, and the compound aperture is positioned along and interrupts the breachable line of disruption which is located between the adjacent blanks.

2. The series of interconnected blanks of claim 1, wherein each blank further comprises a brace formed in the top panel, the brace comprising at least one brace flap defined at least in part by a breachable line of disruption in the top panel.

3. A series of interconnected blanks, each blank having two longitudinal end edges and two lateral end edges extending generally between the longitudinal end edges, two adjacent blanks of the series of interconnected blanks being connected to one another at adjacent longitudinal end edges by a breachable line of disruption, each blank comprising:

a first side panel;

at least one top panel;

a second side panel;

a bottom panel foldably connected to the first side panel at a first fold line and foldably connected to the second side panel at a second fold line;

at least one receiving aperture in the bottom panel;

at least one pivot panel that is hingedly attached to the bottom panel adjacent to the at least one receiving aperture, wherein at least a portion of the at least one pivot panel defines an edge of the at least one receiving aperture; and a plurality of locating apertures formed in a respective one of the two longitudinal end edges, each of the plurality of locating apertures is located at a respective corner of the bottom panel and is adjacent at least one of the first fold line and the second fold line, wherein each locating aperture of the plurality of locating apertures extends into the bottom panel from at least one straight portion of the respective one of the two longitudinal end edges, wherein at least one of the plurality of locating apertures of each blank cooperates with a respective locating aperture of an adjacent blank of the series of interconnected blanks to form cooperating locating apertures, the cooperating locating apertures being generally aligned with the breachable line of disruption between the adjacent blanks.

4. The series of interconnected blanks of claim 1, wherein for each blank, the at least one top panel comprises a first top panel and a second top panel, the first top panel including a locking aperture and the second top panel including a locking projection.

5. A package, comprising:

a generally tubular carton comprising a series of interconnected erected blanks, each erected blank of the series of interconnected erected blanks having two longitudinal end edges and two lateral end edges extending generally between the longitudinal end edges, the generally tubular carton comprising a first side panel, at least one top panel, a second side panel, a bottom panel foldably connected to the first side panel at a first fold line and foldably connected to the second side panel at a second fold line, wherein the bottom panel includes corners that are each at least partially defined by both a respective one of the longitudinal end edges and a respective one of the first and second fold lines, and at least one receiving aperture in the bottom panel; and at least one container received in the at least one receiving aperture, the at least one container having a flange, the flange being supported by, and in contact with, the bottom panel, the generally tubular carton having two opposite end edges corresponding to the longitudinal end edges of respective erected blanks of the series of interconnected erected blanks, each of the two opposite end edges of the generally tubular carton having a plurality of locating apertures formed therein, each of the plurality of locating apertures is located at a respective corner of the bottom panel and is adjacent at least one of the first fold line and the second fold line, wherein each locating aperture of the plurality of locating apertures extends into the bottom panel from at least one straight portion of the respective one of the two opposite end edges of the generally tubular carton.

6. The package of claim 5, further comprising a brace formed in the top panel, the brace comprising at least one brace flap extending into an interior of the package.

7. A package formed from a series of interconnected blanks each having two longitudinal end edges and two lateral end edges extending generally between the longitudinal end edges, the package comprising:

a first side panel;

at least one top panel;

a second side panel;

a bottom panel foldably connected to the first side panel at a first fold line and foldably connected to the second side panel at a second fold line, wherein the first side panel, the second side panel, the bottom panel and the top panel comprise a generally tubular carton;

at least one receiving aperture in the bottom panel;

at least one container received in the at least one receiving aperture, the at least one container having a flange, the flange being supported by, and in contact with, the bottom panel; and at least one pivot panel that is hingedly attached to the bottom panel and extends generally downwardly and abuts the at least one container, wherein at least a portion of the at least one pivot panel defines an edge of the at least one receiving aperture;

the generally tubular carton having two end edges corresponding to the longitudinal end edges of respective blanks of the interconnected blanks, each of the two end edges of the generally tubular carton having a plurality of locating apertures formed therein, each of the plurality of locating apertures is located at a respective corner of the bottom panel and is adjacent at least one of the first fold line and the second fold line, wherein each locating aperture of the plurality of locating apertures extends into the bottom panel from at least one straight portion of the respective one of the two end edges of the generally tubular carton.

8. The package of claim 5, wherein at least one brace panel is hingedly attached to the bottom panel and extends generally upwardly and abuts the at least one container.

9. The package of claim 5, wherein the at least one top panel comprises a first top panel and a second top panel, the first top panel including a locking aperture and the second top panel including a locking projection, wherein the locking projection extends through the locking aperture.

10. The package of claim 8, wherein the at least one brace panel engages the underside of a flange of the at least one container.

11. The package of claim 5, wherein the at least one container comprises at least two containers.

12. The package of claim 5, wherein the at least one container comprises at least four containers arranged in at least two rows and at least two columns.

13. The series of interconnected blanks of claim 1, wherein each locating aperture of the plurality of locating apertures comprises an aperture edge, the bottom panel comprises at least one bottom panel edge, and at least a portion of the bottom panel edge is collinear with the aperture edge and at least a portion of the at least one straight portion of the respective one of the two longitudinal end edges.

14. The package of claim 5, wherein each locating aperture of the plurality of locating apertures comprises an aperture edge, the bottom panel comprises at least one bottom panel edge, and at least a portion of the bottom panel edge is collinear with the aperture edge and at least a portion of the at least one straight portion of the respective one of the two longitudinal end edges.

15. The series of interconnected blanks of claim 1, wherein for each blank, each of the plurality of locating apertures is in contact with at least one of the first fold line and the second fold line.

16. The series of interconnected blanks of claim 1, wherein the compound aperture is a circular aperture, the at least one of the plurality of locating apertures of the first blank forms a first half of the circular aperture, and the respective locating aperture of the second blank forms a second half of the circular aperture.

17. The package of claim 5, wherein each of the plurality of locating apertures is in contact with at least one of the first fold line and the second fold line.

18. The package of claim 5, comprising:

a breachable line of disruption connecting first and second longitudinal end edges respectively of first and second erected blanks of the series of interconnected erected blanks, so that each of the line of disruption and the first and second longitudinal end edges extends in the bottom panel; and each of the first and second longitudinal end edges having a plurality of locating apertures formed therein, each of the plurality of locating apertures of the first and second longitudinal end edges being in the bottom panel, wherein at least one of the plurality of locating apertures of the first longitudinal end edge cooperates with a respective locating aperture of the plurality of locating apertures of the second longitudinal end edge to form a compound aperture, so that the compound aperture includes both the at least one of the plurality of locating apertures of the first longitudinal end edge and the respective locating aperture of the plurality of locating apertures of the second longitudinal end edge, and the compound aperture is positioned along and interrupts the breachable line of disruption which is located between the first and second erected blanks.

19. The package of claim 18, wherein the compound aperture is a circular aperture, the at least one of the plurality of locating apertures of the first longitudinal end edge forms a first half of the circular aperture, and the respective locating aperture of the plurality of locating apertures of the second longitudinal end edge forms a second half of the circular aperture.

* * * * *

UNITED STATES PATENT AND TRADEMARK OFFICE

CERTIFICATE OF CORRECTION

PATENT NO. : 8,083,061 B2
APPLICATION NO. : 12/435048
DATED : December 27, 2011
INVENTOR(S) : Fogle et al.

It is certified that error appears in the above-identified patent and that said Letters Patent is hereby corrected as shown below:

Title page, Item (12) & Item (75), delete "Fogel" and insert --Fogle--

Signed and Sealed this
Eighth Day of May, 2012

David J. Kappos

David J. Kappos
*Director of the United States Patent and Trademark Office*